US006840130B2

(12) United States Patent
Toelke et al.

(10) Patent No.: US 6,840,130 B2
(45) Date of Patent: Jan. 11, 2005

(54) ADJUSTABLE BRAKE, CLUTCH AND ACCELERATOR PEDALS

(75) Inventors: Steven Allen Toelke, Royal Oak, MI (US); Michael William Depotter, Berkley, MI (US); Gordon Lloyd Smith, Orion, MI (US); Dean William Reynolds, Boyne Falls, MI (US); James Allen, Elmira, MI (US)

(73) Assignee: Dura Global Technologies, Inc., Rochester Hills, MI (US)

( * ) Notice: Subject to any disclaimer, the term of this patent is extended or adjusted under 35 U.S.C. 154(b) by 0 days.

(21) Appl. No.: 10/087,277

(22) Filed: Mar. 1, 2002

(65) Prior Publication Data

US 2002/0088299 A1 Jul. 11, 2002

Related U.S. Application Data

(63) Continuation of application No. 09/564,355, filed on May 1, 2000, now Pat. No. 6,367,348.

(51) Int. Cl.[7] ..... G05G 1/14
(52) U.S. Cl. ..... 74/512; 74/560; 74/513
(58) Field of Search ..... 74/512, 513, 514, 74/560, 562; G05G 1/14

(56) References Cited

U.S. PATENT DOCUMENTS 4,875,385 A * 10/1989 Sitrin ..... 74/512
5,010,782 A * 4/1991 Asano et al. ..... 74/512
5,086,663 A * 2/1992 Asano et al. ..... 74/512
6,151,985 A * 11/2000 Garber et al. ..... 74/512
6,151,986 A * 11/2000 Willemsen et al. ..... 180/320
6,289,761 B1 * 9/2001 Reynolds et al. ..... 74/512

FOREIGN PATENT DOCUMENTS

FR 2715485 A1 * 7/1995 ..... G05G/1/14
JP 02039217 A * 2/1990 ..... G05G/1/14
JP 07096784 A * 4/1995 ..... B60N/2/06

* cited by examiner

*Primary Examiner*—Marcus Charles
*Assistant Examiner*—Bradley J. Van Pelt
(74) *Attorney, Agent, or Firm*—Richard M. Mescher; Porter Wright; Dean B. Watson

(57) ABSTRACT

An adjustable control pedal for a motor vehicle includes a first member having a slot formed therein, a pin laterally extending into the slot and having an abutment facing the first member on a side of the first member opposite the second member, and a second member rigidly secured to the pin and movable relative to the first member along the slot. A plastic bushing encircles the pin and extends into the slot. The bushing has a flange engaging the first member on a side of the first member opposite the second member. A plastic washer encircles the pin and is located between the first and second members. A spring washer such as a wave or Belleville washer is located between the abutment and the flange and resiliently biases the second member relative to the first member to resist relative lateral movement between the first and second members to reduce lash therebetween. The pin can be ether a guide pin or a drive pin of the control pedal. Various embodiments are disclosed wherein the first and second members are upper and lower pedal arms respectively and are a mounting bracket and an upper pedal arm respectively.

24 Claims, 17 Drawing Sheets

ADJUSTABLE BRAKE, CLUTCH AND ACCELERATOR PEDALS

CROSS-REFERENCE TO RELATED APPLICATIONS

This application is a continuation application of patent application Ser. No. 09/564,355 filed May 1, 2000 now U.S. Pat No. 6,367,348.

STATEMENT REGARDING FEDERALLY SPONSORED RESEARCH

Not Applicable

REFERENCE TO MICROFICHE APPENDIX

Not Applicable

FIELD OF THE INVENTION

The present invention generally relates to an improved control pedal for a motor vehicle and, more particularly, to a control pedal for a motor vehicle which is selectively adjustable to desired positions.

BACKGROUND OF THE INVENTION

Control pedals are typically provided in a motor vehicle, such as an automobile, which are foot operated by the driver. Separate control pedals are provided for operating brakes and an engine throttle. When the motor vehicle has a manual transmission, a third control pedal is provided for operating a transmission clutch. A front seat of the motor vehicle is typically mounted on tracks so that the seat is forwardly and rearwardly adjustable along the tracks to a plurality of positions so that the driver can adjust the front seat to the most advantageous position for working the control pedals.

This adjustment method of moving the front seat along the tracks generally fills the need to accommodate drivers of various size, but it raises several concerns. First, this adjustment method still may not accommodate all drivers due to very wide differences in anatomical dimensions of drivers. Second, the position of the seat may be uncomfortable for some drivers. Therefore, it is desirable to have an additional or alternate adjustment method to accommodate drivers of various size.

Many proposals have been made to selectively adjust the position of the control pedals relative to the steering wheel and the front seat in order to accommodate drivers of various size. It would be readily apparent to those skilled in the art that these adjustable control pedals can actuate both conventional cable controls and electronic throttle controls (ETC), because the ETC is a function separate from adjustability and the ETC module would typically be positioned remote from the mechanism for adjustment of the control pedals.

U.S. Pat. Nos. 5,632,183, 5,697,260, 5,722,302, 5,819,593, 5,937,707, and 5,964,125, the disclosures of which are expressly incorporated herein in their entirety by reference, each disclose an example of an adjustable control pedal assembly. This control pedal assembly includes a hollow guide tube, a rotatable screw shaft coaxially extending within the guide tube, a nut in threaded engagement with the screw shaft and slidable within the guide tube, and a control pedal rigidly connected to the nut. The control pedal is moved forward and rearward when an electric motor rotates the screw shaft to translate the nut along the screw shaft within the guide tube. While this control pedal assembly may adequately adjust the position of the control pedal to accommodate drivers of various size, this control pedal assembly is relatively complex and expensive to produce. The relatively high cost is particularly due to the quantity of high-precision machined parts such as, for example, the guide tube and due to the quantity of welded joints.

U.S. Pat. Nos. 3,643,525 and 3,643,524, the disclosures of which are expressly incorporated herein in their entirety by reference, each disclose an example of an adjustable control pedal assembly which is much less expensive to produce. This control pedal assembly includes an upper arm having a single horizontal slot, a rotatable screw shaft attached to the upper arm and extending along the slot, a nut in threaded engagement with the screw shaft and having a pin slidable within the slot, and a control pedal rigidly connected to the nut. The control pedal is moved forward and rearward when an electric motor rotates the screw shaft to translate the nut along the screw shaft. While this control pedal assembly may adequately adjust the position of the control pedal to accommodate drivers of various size and is relatively inexpensive to produce, this control pedal is relatively unstable and can have a relatively large amount of lash. That is, components of the control pedal are subject to vibration during regular operation of the motor vehicle causing the components to rub or strike together causing undesirable noise.

Accordingly, there is a need in the art for an adjustable control pedal assembly which selectively adjusts the position of the pedal to accommodate drivers of various size, is relatively simple and inexpensive to produce, has a stable control pedal, has a relatively low amount of lash, and is highly reliable to operate.

SUMMARY OF THE INVENTION

The present invention provides an adjustable control pedal for a motor vehicle which overcomes at least some of the above-noted problems of the related art. According to the present invention, an adjustable control pedal includes, in combination, a first member having a slot formed therein, a pin laterally extending into the slot, and a second member secured to the pin and movable relative to the first member along the slot. A spring member is provided at the pin which resiliently biases the second member relative to the first member to resist relative lateral movement between the first and second members. In a preferred embodiment the spring member is spring washer such as a wave or Belleville washer.

From the foregoing disclosure and the following more detailed description of various preferred embodiments it will be apparent to those skilled in the art that the present invention provides a significant advance in the technology and art of adjustable control pedal assemblies. Particularly significant in this regard is the potential the invention affords for providing a high quality, feature-rich, low cost assembly. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 2:
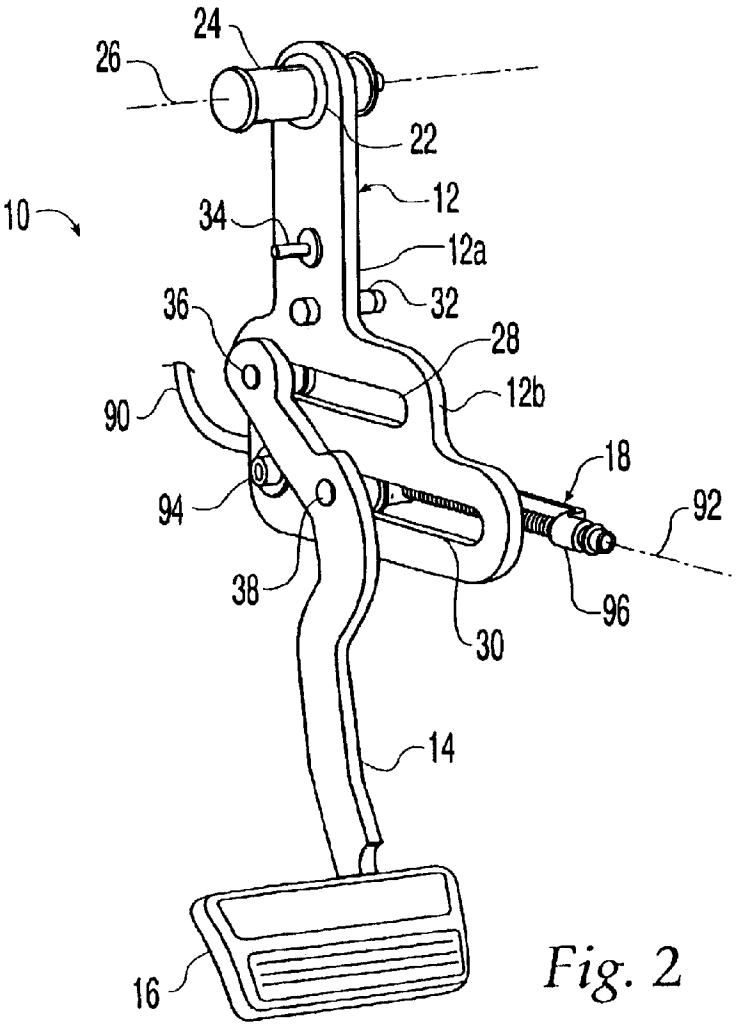
FIG. 2 is a left-rear perspective view of the adjustable control pedal of FIG. 1.
Figure 1:
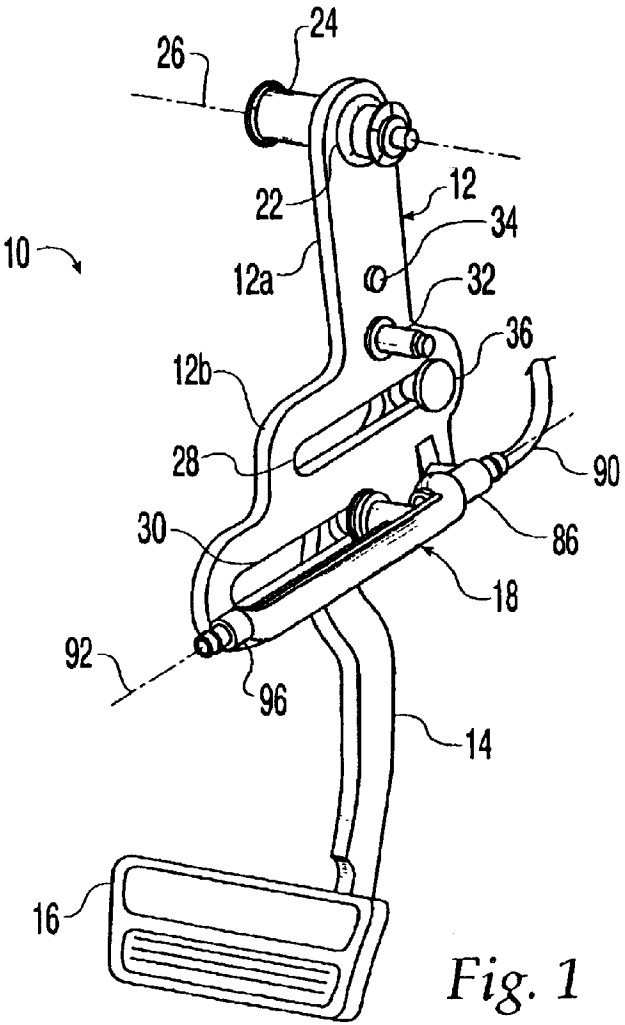
FIG. 1 is a right-rear perspective view of an adjustable control pedal according a first embodiment of the present invention.
Figure 3:
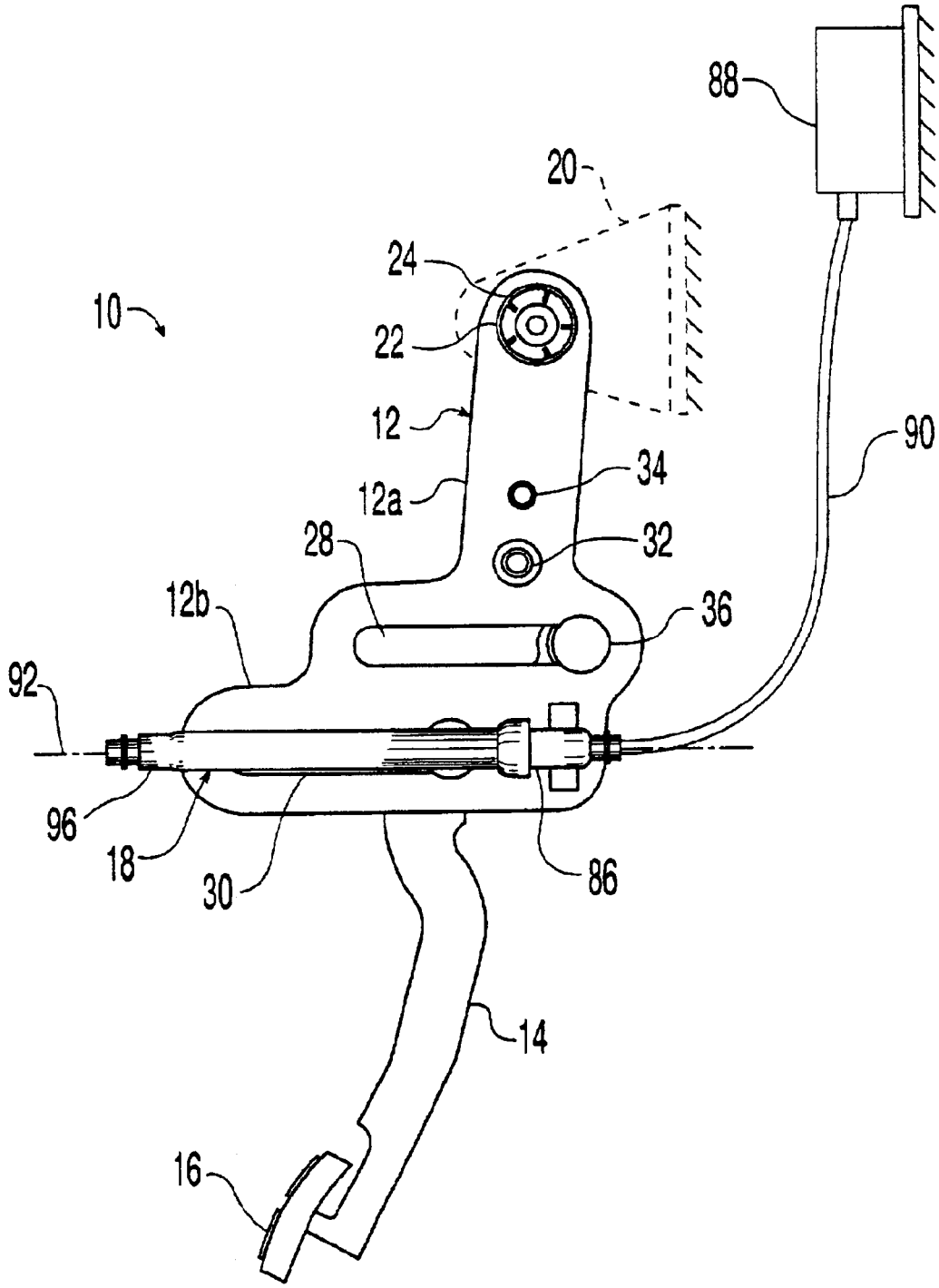
FIG. 3 is a right side elevational view of the adjustable control pedal of FIGS. 1 and 2.
Figure 4:
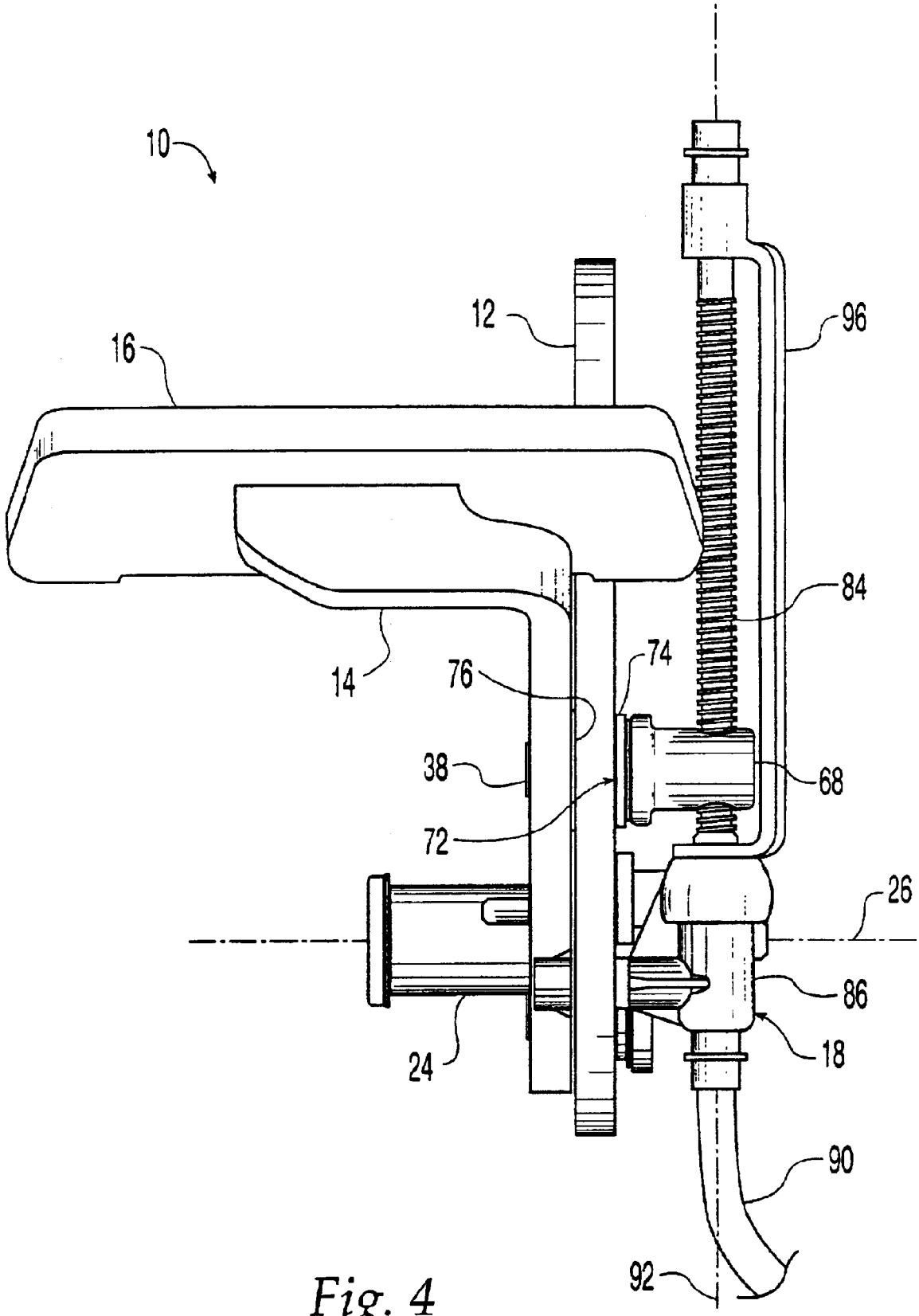
FIG. 4 is a bottom plan view of the adjustable control pedal of FIGS. 1 to 3.
Figure 5:
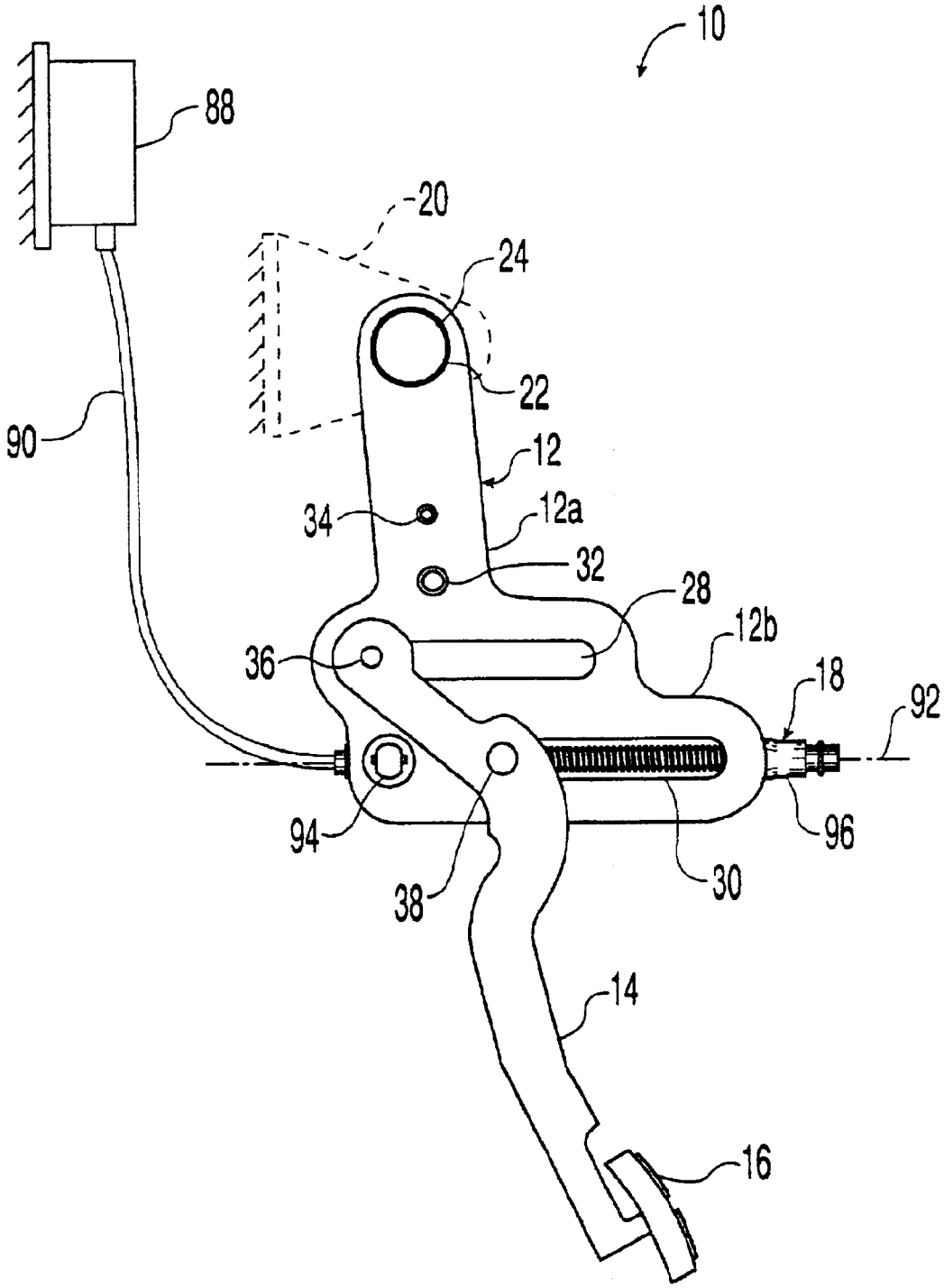
FIG. 5 is a left side elevational view of the adjustable control pedal of FIGS. 1 to 4.
Figure 6:
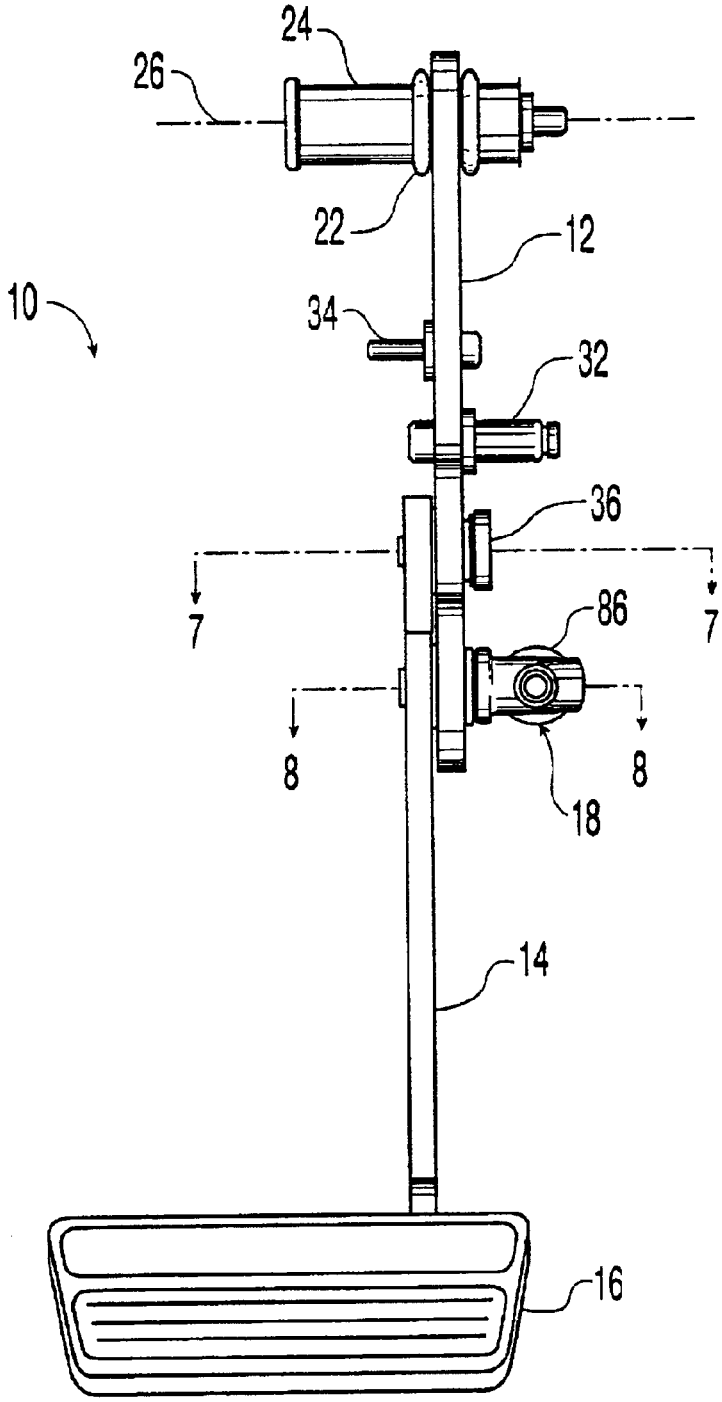
FIG. 6 is a rear elevational view of the adjustable control pedal of FIGS. 1 to 5.

It should be understood that the appended drawings are not necessarily to scale, presenting a somewhat simplified representation of various preferred features illustrative of the basic principles of the invention. The specific design features of an adjustable control pedal as disclosed herein, including, for example, specific dimensions, orientations, and shapes of the pedal arms and the slots will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the control pedal assembly illustrated in the drawings. In general, up or upward refers to an upward direction in the plane of the paper in FIGS. 1, 9, 10, 13, and 16 and down or downward refers to a downward direction in the plane of the paper in FIGS. 1, 9, 10, 13, and 16. Also in general, fore or forward refers to a direction toward the front of the motor vehicle, that is, to the right in the plane of the paper in FIG. 3 and aft or rearward refers to a direction toward the rear of the motor vehicle , that is, to the left in the plane of the paper in FIG. 3.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved adjustable control pedals disclosed herein. The following detailed discussion of various alternative and preferred embodiments will illustrate the general principles of the invention with reference to an adjustable control pedal for use with a motor vehicle. Other embodiments suitable for other applications will be apparent to those skilled in the art given the benefit of this disclosure.

Referring now to the drawings, FIGS. 1 to 6 show an adjustable control pedal 10 for a motor vehicle, such as an automobile, according to a first embodiment of the present invention which is selectively adjustable to a desired forward/rearward position by a motor vehicle operator or driver. While the illustrated embodiments of the present invention are particularly adapted for use with an automobile, it is noted that the present invention can be utilized with any vehicle having at least one foot operated control pedal including trucks, buses, vans, recreational vehicles, earth moving equipment and the like, off road vehicles such as dune buggies and the like, air borne vehicles, and water borne vehicles.

The illustrated adjustable control pedal 10 is adapted as a brake pedal but it is noted that adjustable control pedal 10 can alternatively be adapted as a clutch, accelerator, or other desired pedal within the scope of the present invention. While a single adjustable control pedal 10 is illustrated, it is also noted that two control pedals 10 can be utilized together within the scope of the present invention such as, for example, control pedals 10 adapted as brake and accelerator pedals respectively. It is further noted more than two control pedals 10 can be utilized together within the scope of the present invention such as, for example, three control pedals 10 adapted as clutch, brake and accelerator pedals respectively. The control pedal 10 is selectively adjustable by the motor vehicle operator in a forward/rearward direction as described in more detail hereinafter. When more than one adjustable control pedal 10 is utilized, the control pedals 10 are preferably adjusted together simultaneously to maintain desired relationships between the control pedals 10 such as, for example, "step over", that is, the forward position of the accelerator pedal relative to the brake pedal, and "pedal angles", that is, the orientation of the contact surfaces of the pedal pads. It is noted however, that individual adjustment of a single control pedal 10 is within the scope of the present invention.

The control pedal 10 includes an upper pedal arm 12, a lower pedal arm 14 supported by the upper pedal arm 12 and carrying a pad or pedal 16 for engagement by the foot of the motor vehicle operator, and a drive assembly 18 for moving of the lower pedal arm 14 relative to the upper pedal arm 12 to adjust the position of the pedal 16. The upper pedal arm 12 is sized and shaped for pivotal attachment to a mounting bracket 20. The mounting bracket 20 is adapted to rigidly attach the adjustable control pedal 10 to a firewall or other rigid structure of the motor vehicle in a known manner. The upper pedal arm 12 is adapted for pivotal attachment to the mounting bracket 20. The illustrated upper pedal arm 12 has an opening 22 formed for cooperation with the mounting bracket 20 and an axle or pivot pin 24. With the pivot pin 24 extending through the mounting bracket 20 and the opening 22 of the link upper pedal arm 12, the upper pedal arm 12 is pivot able relative to the fixed mounting bracket 20 about a horizontally and laterally extending pivot axis 26 formed by the central axis of the pivot pin 24.

The illustrated upper pedal arm 12 is an elongate plate oriented in a vertical plane. The upper pedal arm 12 is preferably formed of a suitable metal such as steel but can alternatively be formed of a suitable plastic such as NYLON. The illustrated upper pedal arm 12 is generally "L-shaped" having a generally vertical upper portion 12*a* which generally extends downward from the pivot axis 26 and a generally horizontal lower portion 12*b* which generally extends in a rearward direction from a lower end of the upper portion 12*a*. The upper portion 12*a* is adapted for pivotal attachment of the lower pedal arm 14 to the mounting bracket 20 as described herein above. The illustrated opening 22 is located near the top of the upper portion 12*a* but the opening 22 can have other suitable locations on the upper pedal arm 12 within the scope of the present invention.

The lower portion 12*b* is adapted for supporting the lower pedal arm 14 and for selected fore and aft movement of the lower pedal arm 14 along the lower portion 12*b* as described in more detail hereinafter. The illustrated lower portion 12*b* has a pair of vertically spaced apart and parallel slots 28, 30 formed therein which generally extend in a forward/rearward direction along the length of the link lower portion 12*b*. The illustrated slots 28, 30 are each substantially straight and horizontal. Preferably, the drive or lower slot 30 is offset rearward of the guide or upper slot 28 but overlapping the upper slot 28. The lower portion 12*b* is substantially planar or flat in the area of the slots 28, 30 and the slots 28, 30 are open laterally through the entire thickness of the upper pedal arm 12. The slots 28, 30 are sized and shaped for cooperation with the lower pedal arm 14 for substantially linear forward/rearward movement of the pedal 16 relative the upper pedal arm 12 over a desired adjustment range, such as about three inches, as described in more detail hereinbelow. It is noted that the separate upper and lower slots 28, 30 can alternatively be separate portions of a single slot such as a "C-shaped", "S-shaped", or other nonlinear slot.

The upper pedal arm 12 is operatively connected to a control device such as a clutch, brake or throttle such that pivotal movement of the upper pedal arm 12 about the pivot axis 26 operates the control device in a desired manner. The upper pedal arm 12 can be connected to the control device by, for example, a push-pull or Bowden cable for mechanical actuation or by a sensor and electrical wire or cable for electronic actuation. The illustrated upper pedal arm 12 is provided with a pin 32 for connection to the control device by a mechanical actuator. The illustrated upper pedal arm is also provided with a pin 34 for connection to a switch for indicator lights such as brake lights.

The lower pedal arm 14 is preferably formed of a suitable metal such as steel but one or both can alternatively be formed of a suitable plastic such as NYLON. The illustrated lower pedal arm 14 is formed of an elongate plate oriented in a vertical plane substantially parallel to plane of the upper pedal arm 12. The upper end of the lower pedal arm 14 is adapted for linear movement relative to upper pedal arm 12 along the slots 28, 30. The upper end of the lower pedal arm 14 is provided with guide and drive pins 36, 38 laterally and horizontally extending therefrom to cooperate with the slots 28, 30 of the upper pedal arm 12 to form sliding pin and slot connections for linearly moving the lower pedal arm 14 relative to the upper pedal arm 12. The lower end of the lower pedal arm 14 is sized and shaped to carry the rearward-facing pedal 16. The pedal 16 is adapted for depression by the driver of the motor vehicle to pivot the control pedal 10 about the pivot axis 26 to obtain a desired control input to the motor vehicle through the movement of the pin 32.

Figure 7:
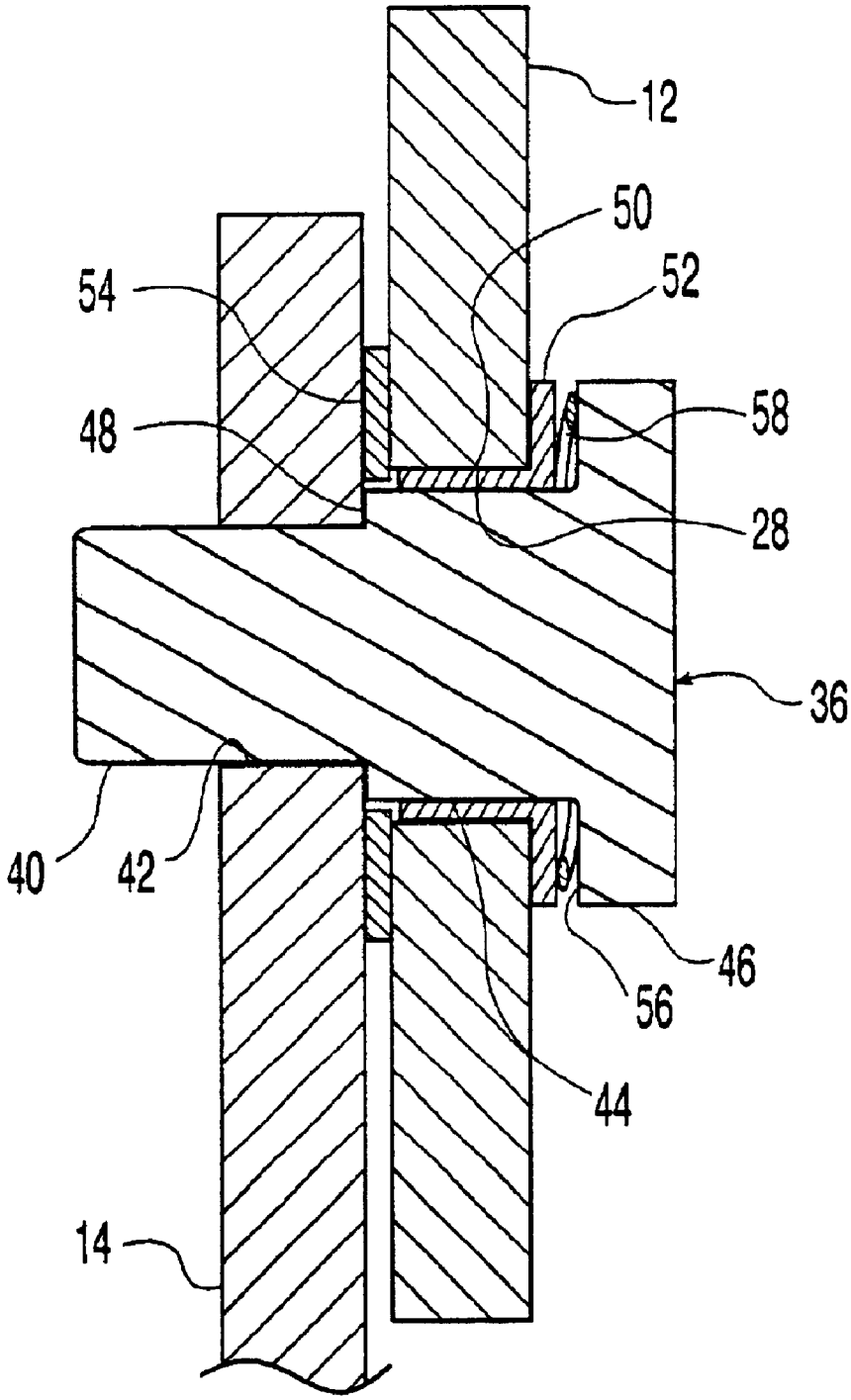
FIG. 7 is a cross-sectional view taken along line 7—7 of FIG. 6.

As best shown in FIG. 7, the illustrated guide pin 36 has a first portion 40 sized for cooperating with an opening 42 in the lower pedal arm 14, a second portion 44 sized for cooperating with the upper slot 28 in the upper pedal arm 12, and a flange 46 adjacent the second portion 44 and opposite the first portion 40. The first portion 40 is preferably rigidly secured to the lower pedal arm 14. The guide pin 36 is preferably secured to the lower pedal arm 14 by spin forming but can alternatively be secured in any suitable manner such as, for example, welding, a threaded connection with a nut, or a threaded connection with the lower pedal arm 14.

The second portion 44 is preferably sized larger than the first portion 40 to form a first abutment 48 which engages the lower pedal arm 14. The second portion 44 is also sized to cooperate with a bushing 50 to extend within the upper slot 28 with minimal vertical movement or "play" therein. The bushing flange 52 is sized to engage the upper pedal arm 12 adjacent the upper slot 28. The bushing 50 is preferably formed of a suitable plastic material but can alternatively be any suitable wear resistant and/or low friction material. Preferably, a spacer or washer 54 is located about the second portion 44 between the upper and lower pedal arms 12, 14. The washer 54 is preferably formed of a suitable plastic material but can alternatively be any suitable wear resistant and/or low friction material. The guide pin flange 46 is preferably sized larger than the guide pin second portion 44 and the upper slot 28 to form a second abutment 56 which faces the outer lateral side of the upper pedal arm 12. The length of the second portion 44 is preferably sized to permit limited lateral movement of the upper pedal arm 12 relative to the lower pedal arm 14 between the lower pedal arm 14 and the guide pin flange 46 so that there is "lateral play" between the upper and lower pedal arms 12, 14.

A spring member 58 is provided between the guide pin flange 46 and the bushing flange 52 to resiliently bias or urge the upper pedal arm 12 and the washer 54 against the lower pedal arm 14 and to "take up the lateral play" but allow resilient side to side movement. The spring member 58 is preferably a spring washer such as a wave or Belleville washer but can alternatively be any suitable spring member such as, for example, a leaf spring. Mounted in this manner, the spring member 58 reduces or resists lateral relative movement between the upper and lower pedal arms to reduce lash in the lateral direction.

Figure 8:
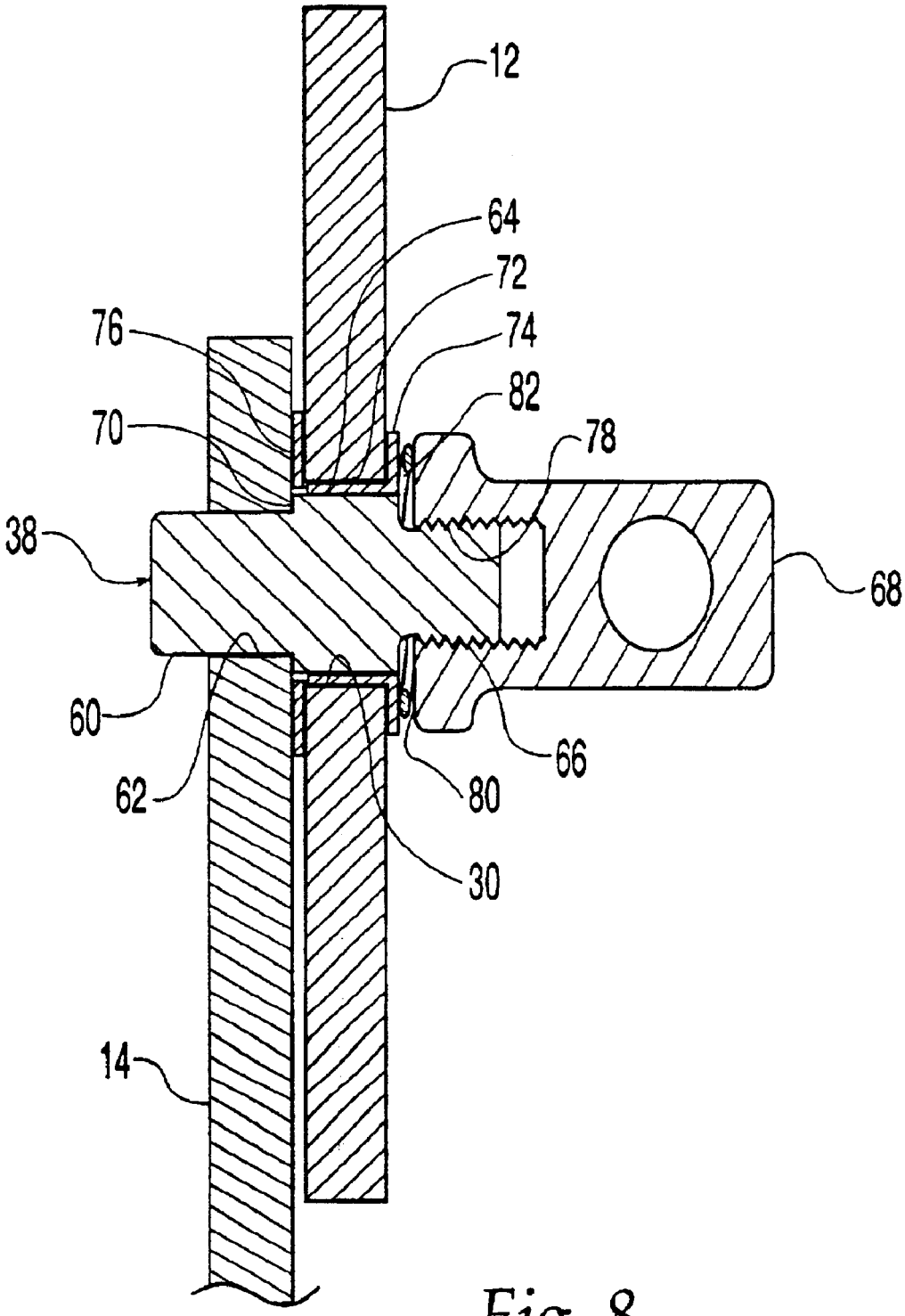
FIG. 8 is a cross-sectional view taken along line 8—8 of FIG. 6.

As best shown in FIG. 8, the illustrated drive pin 38 has a first portion 60 sized for cooperating with an opening 62 in the lower pedal arm 14, a second portion 64 sized for cooperating with the lower slot 30 in the upper pedal arm 12, and a third portion 66 sized for cooperation with a drive nut 68 of the drive assembly 18. The first portion 60 is preferably rigidly secured to the lower pedal arm 14. The drive pin 38 is preferably secured to the lower pedal arm 14 by spin forming but can alternatively be secured in any suitable manner such as, for example, welding, a threaded connection with a nut, or a threaded connection with the lower pedal arm 14.

The second portion 64 is preferably sized larger than the first portion 60 to form a first abutment 70 which engages the lower pedal arm 14. The second portion 64 is also sized to cooperate with a bushing 72 to extend within the lower slot 30 with minimal vertical movement or "play" therein. The bushing flange 74 is sized to engage the upper pedal arm 12 adjacent the lower slot 30. The bushing 72 is preferably formed of a suitable plastic material but can alternatively be any suitable wear resistant and/or low friction material. Preferably, a spacer or washer 76 is located about the second portion between the upper and lower pedal arms 12, 14. The washer 76 is preferably formed of a suitable plastic material but can alternatively be any suitable wear resistant and/or low friction material. The drive pin third portion 66 is adapted to cooperate with the drive nut 68 for a rigid connection therebetween. The illustrated drive pin third portion 66 is provided with threads which cooperate with a threaded bore 78 within the drive nut 68. The drive nut 68 is sized larger than the guide pin second and third portions 64, 66 and the lower slot 30 to form a second abutment 80 which faces the lateral side of the upper pedal arm 12. The length of the second portion 64 is preferably sized to permit limited lateral movement of the upper pedal arm 12 relative to the lower pedal arm 14 between the lower pedal arm 14 and the drive nut abutment 80 so that there is "lateral play" between the upper and lower pedal arms 12, 14.

A spring member 82 is provided between the drive nut abutment 80 and the bushing flange 74 to resiliently bias the upper pedal arm 12 and the washer 76 against the lower pedal arm 14 and to "take up the lateral play" but allow resilient side to side movement. The spring member 82 is preferably a spring washer such as a wave or Belleville washer but can alternatively be any suitable spring member such as, for example, a leaf spring. Mounted in this manner, the spring member 82 reduces or resists lateral relative movement between the upper and lower pedal arms to reduce lash in the lateral direction. It is noted that the guide and drive pins 36, 38 can be secured to the lower pedal arm 14 as illustrated or alternately formed as a single part, that is unitary, with the lower pedal arm 14.

As best shown in FIGS. 1 to 6, the axes of the guide and drive pins 36, 38 are preferably horizontally offset, that is, the axes of the guide and drive pins 36, 38 are preferably not in the same vertical plane to provide stability to the lower pedal arm 14. In the illustrated embodiment, the drive pin 38 is located rearward of the guide pin 36. The guide and drive pins 36, 38 are spaced apart along the lower pedal arm 14 a distance adequate to permit sliding of the pins 36, 38 along the slots 28, 30. The guide and drive pins 36, 38 extend through the slots 28, 30 of the upper pedal arm 12 so that the lower pedal arm 14 is supported by the upper pedal arm 12 by contact of the guide and drive pins 36, 38 with bottom bearing surfaces of the slots 28, 30 and the lower pedal arm 14 is movable fore and aft relative to the upper pedal arm 12 as the guide and drive pins 36, 38 slide along the bottom bearing surfaces of the slots 28, 30. It is noted that the pins 36, 38 can engage ends of the slots 46 to provide limits to the movement of the lower pedal arm 14 relative to the upper pedal arm 16 or the drive assembly 18 can provide electronic stops.

The drive assembly 18 includes a screw shaft or drive screw 84, a drive screw attachment or housing 86 for securing the drive assembly 18 to the upper pedal arm 12, the drive nut 68 adapted for movement along the drive screw 84 in response to rotation of the drive screw 84, an electric motor 88 for rotating the drive screw 84, and a drive cable 90 for connecting the motor 88 to the drive screw 84 and transmitting rotation motion thereto.

The drive screw 84 is an elongate shaft having a threaded portion adapted for cooperation with the drive nut 68. The drive screw 84 is preferably formed of metal such as, for example, steel but can be alternately formed of a plastic resin such as, for example, NYLON. The forward end of the drive screw 84 is journaled by the drive screw housing 86 for rotation of the drive screw 84 by the motor 88. The drive screw 84 rearwardly extends from the drive screw housing 86 generally parallel to and adjacent the lower slot 30 in the upper pedal arm 12 in a cantilevered fashion. Mounted in this manner, the drive screw 84 is substantially horizontal. The drive screw 84 can be connected to the drive screw housing 86 with a self-aligning or freely pivoting joint, that is, a joint which freely permits pivoting of the drive screw 84 relative to the drive screw housing 86 and the upper pedal arm 12 about at least axes perpendicular to the drive screw rotational axis 92. The self-aligning joint automatically corrects misalignment of the drive screw 84 and/or the drive nut 68. The self-aligning joint also allows the lower slot 30 to be nonlinear when desired. The self aligning joint can be, for example, a ball/socket type joint.

The drive screw housing 86 is sized and shaped for supporting the forward end of the drive screw 84 and attaching the drive screw 84 to the upper pedal arm 12. The drive screw housing 86 is preferably molded of a suitable plastic material such as, for example, NYLON but can alternatively be formed of metal such as steel. The illustrated drive-screw housing 86 is secured to the upper pedal arm 12 with a snap-fit connection 94. It is noted, however, that the drive screw housing 86 can be unitary with the upper pedal arm 12 or secured to the upper pedal arm 12 in other suitable manners such as, for example, mechanical fasteners.

The drive nut 68 is adapted for axial movement along the drive screw 84 in response to rotation of the drive screw 84. The drive nut 68 is preferably molded of a suitable plastic material such as, for example, NYLON but can alternatively be formed of metal such as, for example steel. The drive nut 68 is secured to the drive pin 38 as described herein above. The drive pin 36 can be alternatively connected to the drive nut 68 with a self-aligning or freely pivoting joint, that is, a joint which freely permits pivoting of the drive nut 68 relative to the drive pin 36 about at least axes perpendicular to the rotational axis 92 of the drive screw 84. The self-aligning joint automatically corrects misalignment of the drive nut 68 and/or drive screw 84. The self aligning joint can be, for example, a ball/socket type joint.

The electric motor 88 can be of any suitable type and can be secured to the firewall or other suitable location such as, for example, the mounting bracket 20. The drive cable 90 is preferably a flexible push-pull cable and connects the motor 88 and the forward end of the drive screw 84 so that rotation of the motor 88 rotates the drive screw 84. It is noted that the drive screw 84 and the motor 88 can be alternatively connected with a rigid connection. An input end of the drive cable 90 is connected to an output shaft of the motor 88 and an output end of the drive cable 90 is connected to an end of the drive screw 84. It is noted that suitable gearing is provided between the motor 88 and the drive screw 84 as necessary depending on the requirements of the control pedal 10. It is also noted that the fixed portion or sheath of the drive cable 90 is rigidly secured to the forward end of the drive screw housing 86 and a rotating portion of the cable 90 is operatively connected to the forward end of the drive screw 84 to rotate the drive screw 84 therewith. The illustrated drive assembly 18 also includes a cable support 96. The cable support 96 enables a drive cable for another control pedal to be connected to the rearward end of the drive screw 84. Connecting or chaining the drive screws 84 with the electric motor 88 in series enables a single drive motor 88 to be utilized to operate multiple control pedals. See U.S. patent application Ser. No. 09/492,238, the disclosure of which is expressly incorporated herein in its entirety by reference, for a more detailed description of a suitable drive screw, housing, and/or cable support.

Preferably, a controller including processing means and memory means are adapted to control operation of the motor. The controller can be a dedicated controller, the motor vehicle control unit, or a controller of another system of the motor vehicle such as, for example, a keyless entry system or a powered seat system. See U.S. patent application Ser. No. 09/492,636, the disclosure of which is expressly incorporated herein in its entirety by reference, for a more detailed description of a suitable control system having a controller.

To adjust the control pedal 10, the driver engages a control switch which activates rotation of the motor 88 in the desired direction. Rotation of the motor 88 rotates the drive screw 84 through the drive cable 90 and causes the drive nut 68 to axially move along the drive screw 84 in the desired direction. The drive nut 68 moves along the drive screw 84 because the drive nut 68 is held against rotation with the drive screw 84 by the drive pin 38. As the drive nut 68 axially moves along the drive screw 64, the drive pin 38 moves along the lower slot 30 because the drive pin 38 is secured to the drive nut 68. It is noted that binding of the drive nut 68 along the drive screw 84 is minimized if a self-aligning joint is provided, between the drive screw 84 and the drive screw housing 86 and/or the drive nut 68 and the drive pin 38, to automatically align the components so that the drive nut 68 can smoothly travel along the drive screw 84. As the drive pin 38 slidingly moves along the lower slot 30, the lower pedal arm 14 is moved therewith to adjust the forward/rearward position of the pedal 16. As the lower pedal arm moves 14, the guide pin 36 slides along the upper slot 28. With such movement, the pedal 16 travels in a substantially linear and horizontal path, that is, the pedal 16 moves in a forward/rearward direction and generally remains at the same height relative to the fixed mounting bracket 20 and the upper pedal arm 12 which does not move relative the mounting bracket 20 during adjustment of the pedal 16. Additionally, the pedal is not rotated as the lower pedal arm 14 moves so that the orientation of the pedal does not change. As the position of the pedal 16 is adjusted by rotating the drive screw 84, the upper pedal arm 12 remains in fixed position relative to the mounting bracket 20. It can be seen from the above description that activation of the motor 88 changes the position of the lower pedal arm 14 relative to the upper pedal arm 12 but not the position of the upper pedal arm 12 relative to the mounting bracket 20 and therefore does not affect the connection of the upper pedal arm 12 to the control device of the motor vehicle through the pin 32.

Figure 9:
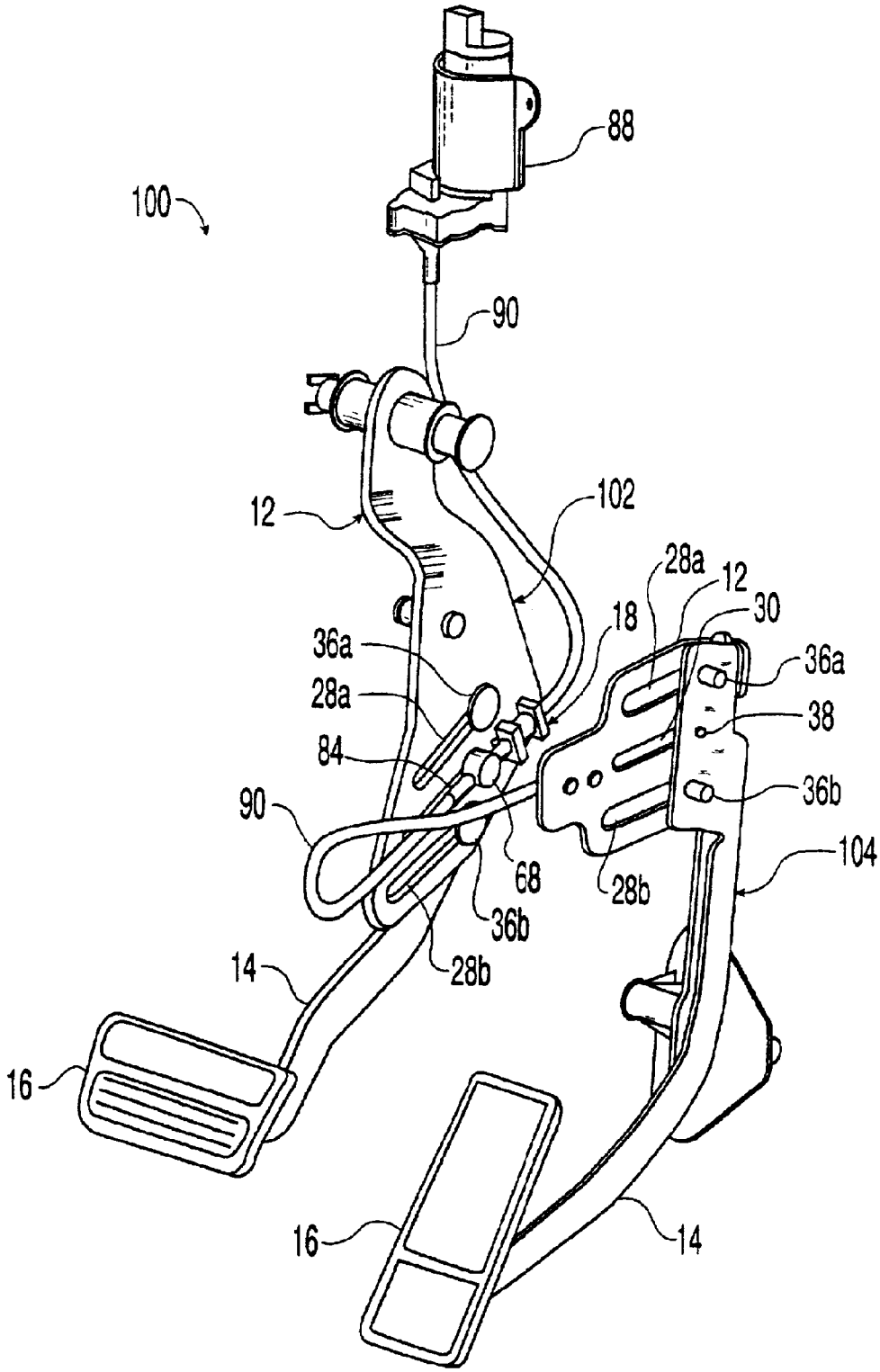
FIG. 9 is a right-rear perspective view of an adjustable control pedal assembly according to a second embodiment of the present invention.

FIG. 9 illustrates a control pedal assembly 100 for a motor vehicle according to a second embodiment of the present invention wherein like reference numbers are used for like structure. The illustrated control pedal assembly 100 includes a brake pedal 102 and an accelerator pedal 104 connected in series to the electric motor 88. The brake pedal 102 according to the second embodiment is substantially similar to the first embodiment described herein above with reference to FIGS. 1 to 8, except that there are a pair of guide pins 36*a*, 36*b* and guide slots 28*a*, 28*b* and the guide slots 28*a*, 28*b* are non-parallel and angled downward in a rearward direction, that is the forward end is located higher than the rearward end. The upper and lower guide slots 28*a*, 28*b* are preferably located on opposite sides of the drive slot 30. The upper and lower guide pins 36*a*, 36*b* can be the same as described in detail herein above with regard to the first embodiment. The drive pin 38 and the drive slot 30 can be as described in detail herein above with regard to the first embodiment or can be sized as a clearance opening to provide no support for the lower pedal arm 14. The axes of the upper and lower guide pins 36*a*, 36*b* are preferably horizontally offset, that is, the axes of the upper and lower guide pins 36*a*, 36*b* are preferably not in the same vertical plane to provide stability to the lower pedal arm 14. In the illustrated embodiment, the lower guide pin 36*b* is located rearward of the upper guide pin 36*a*.

The brake pedal 102 according to the second embodiment also illustrates that the guide slots 28*a*, 28*b* can be non-parallel and angled or inclined downward in a rearward direction. The guide slots 28*a*, 28*b* are sized and shaped such that as the guide pins 36*a*, 36*b* travel along the guide slots 28*a*, 28*b*, the pedal 16 moves along a substantially linear horizontal path. The guide slots 28*a*, 28*b* are non-parallel to pivot the lower pedal arm 14 as the guide pins 36*a*, 36*b* travel along the guide slots 28*a*, 28*b* so that the pedal 16 moves along the substantially linear horizontal path. Because the lower pedal arm 14 pivots, there must be pivotable movement in the drive assembly 18 between the lower pedal arm 14 and the upper pedal arm 12 such as, for example, the drive pin 38 pivotable relative to the lower pedal arm 14, the drive nut 68 pivotable relative to the drive pin 38, and/or the drive screw 84 pivotable relative to the housing 86 or upper pedal arm 12. It is noted that the orientation of the pedal 16 somewhat changes as it moves along its substantially linear horizontal path. It should be appreciated that by utilizing inclined or angled guide slots 28*a*, 28*b*, the package size of the control pedal 102 can be optimized for a particular motor vehicle. Particularly, the length of the upper pedal arm 12 in the forward/rearward direction can be significantly reduced. This is particularly advantageous in compact or midsize motor vehicles having power steering because the available space for the control pedal 102 below the steering column is limited.

To adjust the control pedal 102, the driver engages a control switch which activates rotation of the motor 88 in the desired direction. Rotation of the motor 88 rotates the drive screw 84 through the drive cable 90 and causes the drive nut 68 to axially move along the drive screw 84 in the desired direction. The drive nut 68 moves along the drive screw 84 because the drive nut 68 is held against rotation with the drive screw 84 by the drive pin 38. As the drive nut 68 axially moves along the drive screw 84, the drive pin 38 moves along the drive slot 30 because the drive pin 38 is secured to the drive nut 68. It is noted that binding of the drive nut 68 along the drive screw 84 is minimized if a self-aligning joint is provided, between the drive screw 84 and the drive screw housing 86 and/or the drive nut 68 and the drive pin 38, to automatically align the components so that the drive nut 68 can smoothly travel along the drive screw 84. As the drive pin 38 moves along the drive slot 30, the lower pedal arm 14 is moved therewith to adjust the forward/rearward position of the pedal 16. As the lower pedal arm 14 is moved by the drive pin 38, the guide pins 36*a*, 36*b* travel along the guide slots 28*a*, 28*b* to move or translate the lower pedal arm 14 in a forward/rearward direction relative to the upper pedal arm 12 and to pivot the lower pedal arm 14 relative to the upper pedal arm 12. With such movement, the pedal 16 travels in a substantially linear and horizontal path, that is, the pedal 16 moves in a forward/rearward direction and generally remains at the same height relative to the fixed mounting bracket 20 and the upper pedal arm 12 which does not move relative to the mounting bracket 20 during adjustment of the pedal 16. It can be seen from the above description that activation of the motor 88 changes the position of the lower pedal arm 14 and the pedal 16 relative to the upper pedal arm 12 but not the position of the upper pedal arm 12 relative to the mounting bracket 20 and therefore does not affect the connection of the control pedal 102 to the control device of the motor vehicle.

Figure 10:
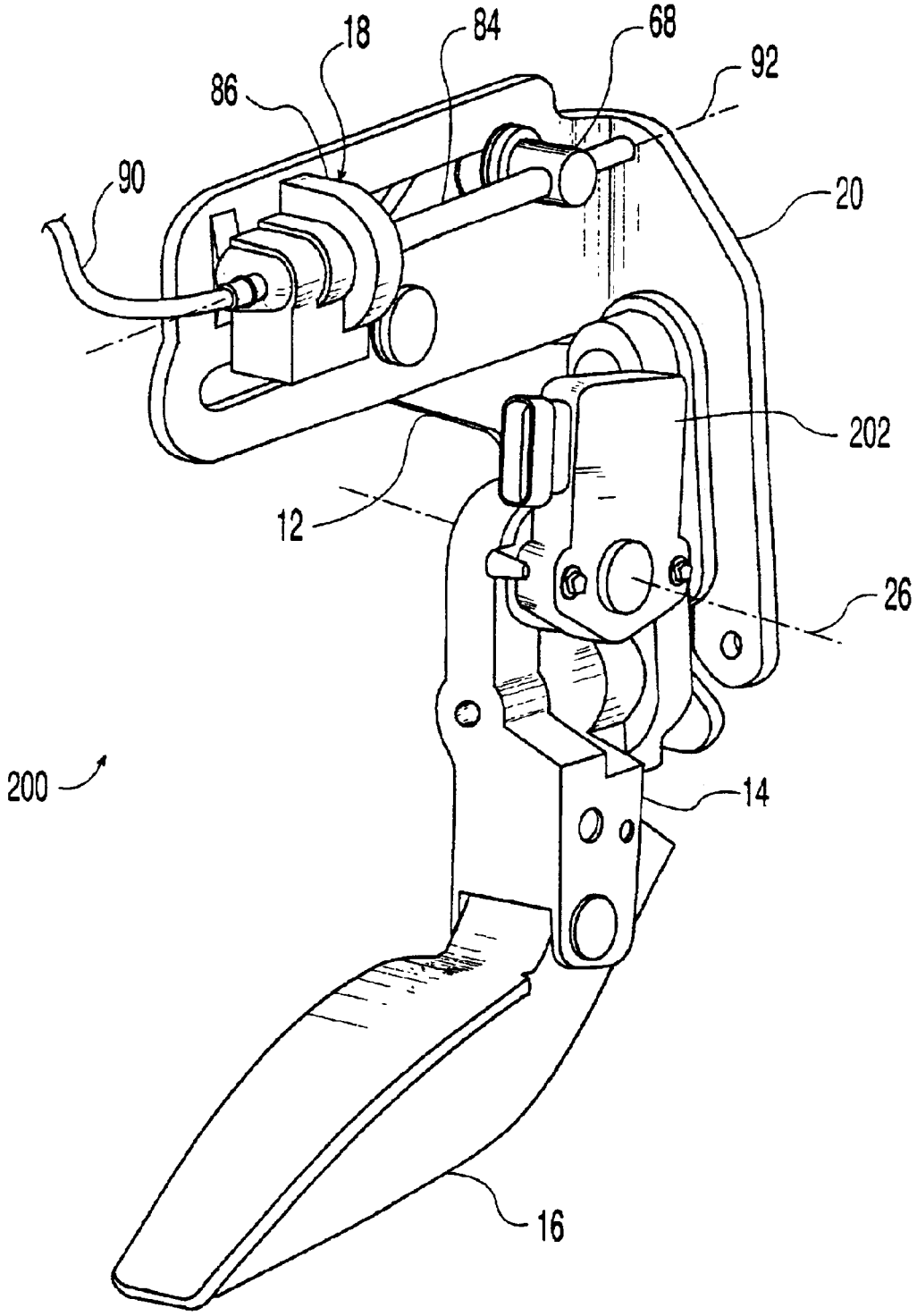
FIG. 10 is a right-rear perspective view of an adjustable control pedal according to a third embodiment of the present invention.
Figure 11:
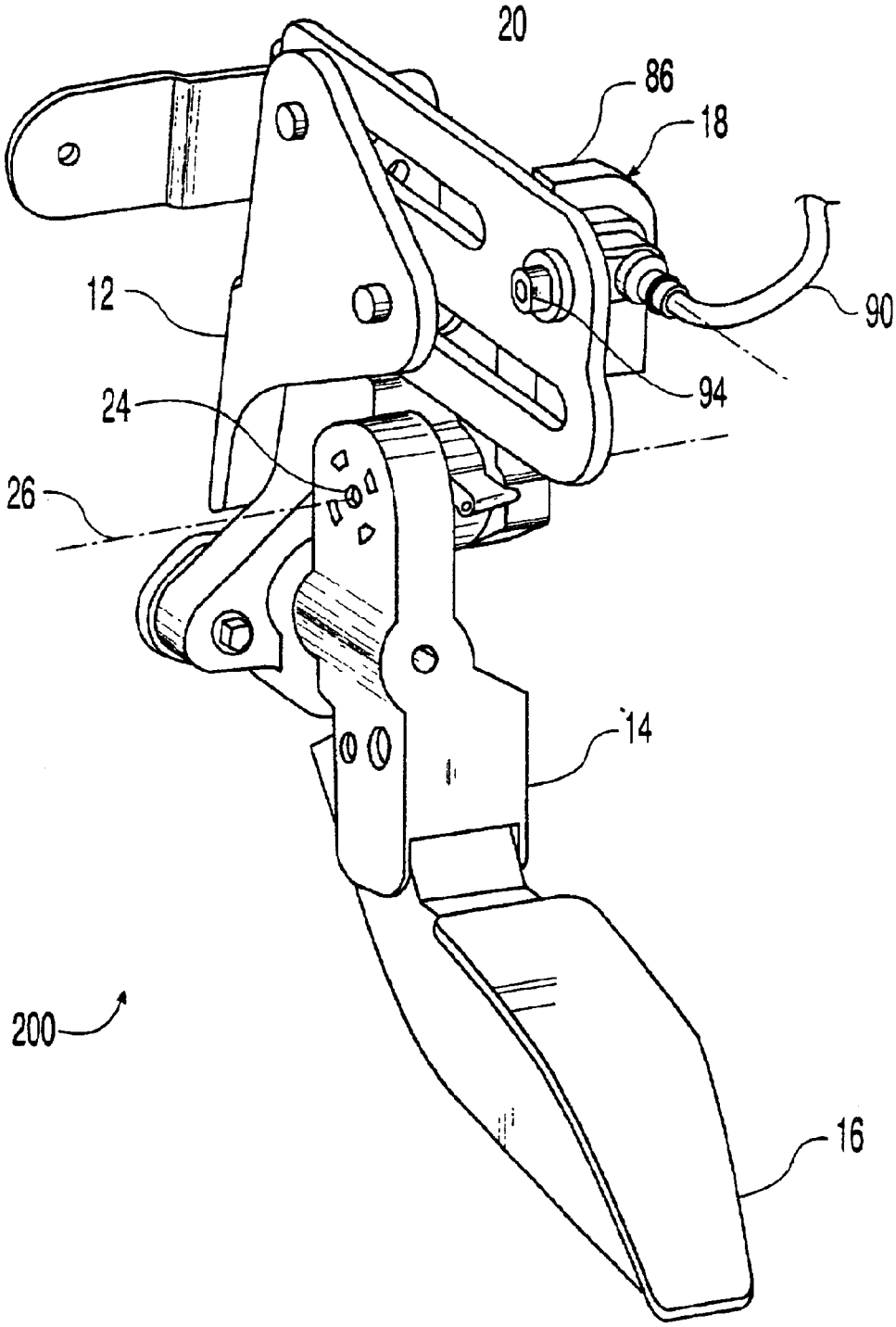
FIG. 11 is a left-rear perspective view of the adjustable control pedal of FIG. 10.
Figure 12:
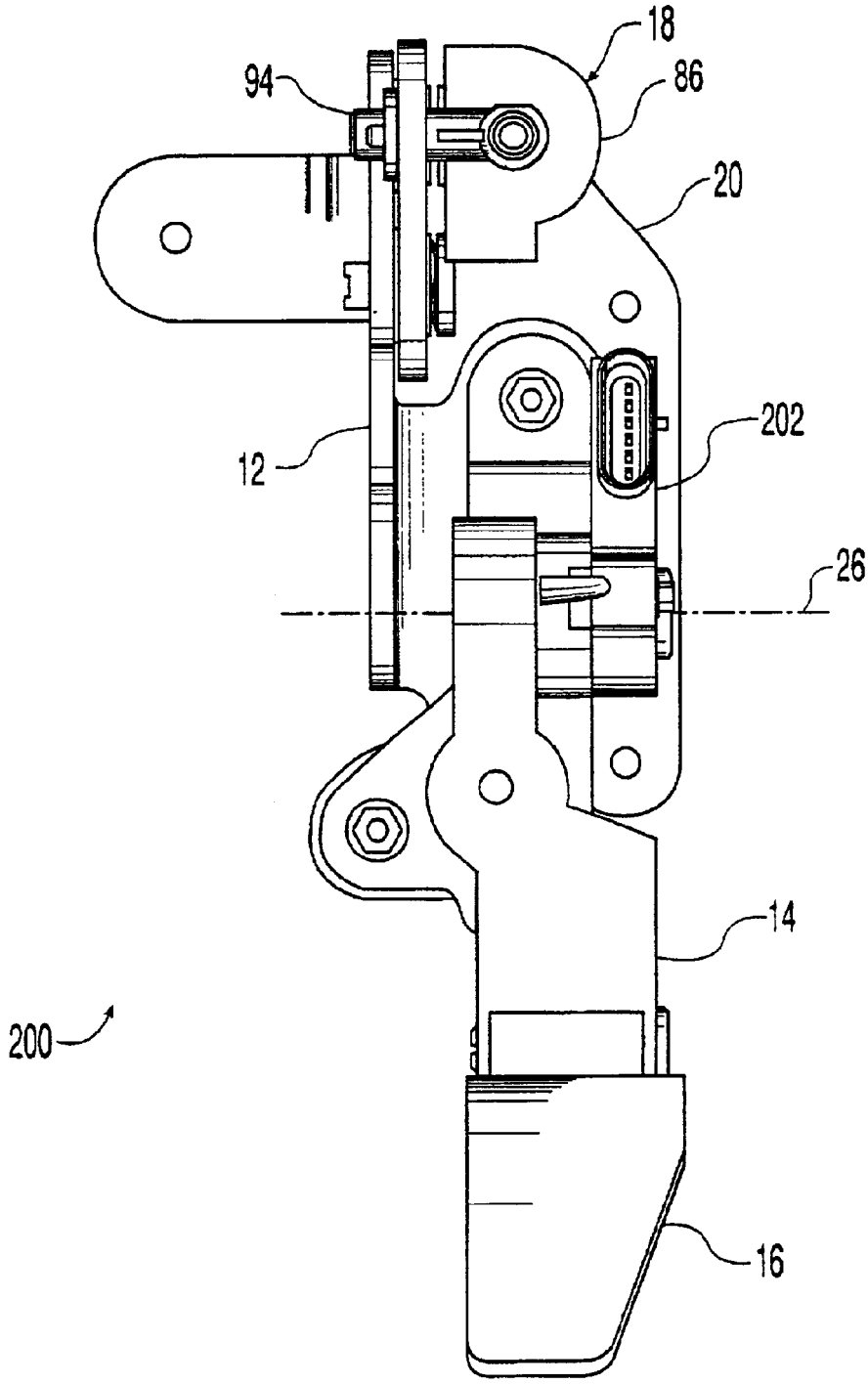
FIG. 12 is a rear elevational view of the adjustable control pedal of FIGS. 10 and 11.

FIGS. 10 to 12 illustrate a control pedal 200 for a motor vehicle according to a third embodiment of the present invention wherein like reference numbers are used for like structure. The illustrated control pedal 200 is an accelerator pedal with electronic throttle control. The control pedal 200 according to the third embodiment is substantially similar to the first and second embodiments described herein above with reference to FIGS. 1-8, except that the forward/rearward adjustment is between the mounting bracket 20 and the upper pedal arm 12, rather than between the upper and lower pedal arms 12, 14, and the pedal 16 and lower pedal arm are pivotably attached to the upper pedal arm, rather than the pedal 16, the lower pedal arm 14, and the upper pedal arm 12 being pivotably attached to the mounting bracket 20.

The control pedal 200 includes the mounting bracket 20, the upper pedal arm 12 supported by the mounting bracket 20, the lower pedal arm 14 supported by the upper pedal arm 12 and carrying the pedal 16 for engagement by the foot of the motor vehicle operator, and the drive assembly 18 for moving of the upper pedal arm 12 relative to the mounting bracket 20 to adjust the position of the pedal 16. The mounting bracket 20 is adapted to rigidly attach the adjustable control pedal 200 to a firewall or other rigid structure of the motor vehicle in a known manner. The upper pedal arm 12 is adapted for fore/aft movement relative to the mounting bracket 20. The illustrated mounting bracket 20 has the pair of vertically spaced apart and parallel slots 28, 30 formed therein which generally extend in a forward/rearward direction along the length of the mounting bracket 20. The illustrated slots 28, 30 are each substantially straight and horizontal. Preferably, the lower slot 30 is offset rearward of the upper slot 28 but overlapping the upper slot 28. The slots 28, 30 are sized and shaped for cooperation with the upper pedal arm 12 for substantially linear forward/rearward movement of the pedal 16 relative the mounting bracket 20 over a desired adjustment range, such as about three inches, as described in more detail hereinbelow.

The upper pedal arm 12 is adapted for linear movement relative to mounting bracket 20 along the slots 28, 30. The upper end of the upper pedal arm 12 is provided with the guide and drive pins 36, 38 laterally and horizontally extending therefrom to cooperate with the slots 28, 30 of the mounting bracket 20 to form sliding pin and slot connections for linearly moving the upper pedal arm 12 relative to the mounting bracket. The guide and drive pins 36, 38 are preferably as described in detail herein above in reference to the first embodiment.

The upper end of the lower pedal arm 14 is pivotably mounted to the upper pedal arm 12 with the pivot pin 24. With the pivot pin 24 extending through the upper and lower pedal arms 12, 14, the lower pedal arm 14 is pivotable relative to the upper pedal arm 12 about a horizontally and laterally extending pivot axis 26 formed by the central axis of the pivot pin 24. The lower end of the lower pedal arm 14 is sized and shaped to carry the rearward-facing pedal 16. The pedal 16 is adapted for depression by the driver of the motor vehicle to pivot the control pedal 10 about the pivot axis 26 to obtain a desired control input to the motor vehicle.

The lower pedal arm 14 is operatively connected to a control device such as a motor vehicle throttle such that pivotal movement of the lower pedal arm 14 about the pivot axis 26 operates the control device in a desired manner. The illustrated lower pedal arm 12 is connected to the control device by an electronic throttle control module ("ETC module") 202 for electronic actuation. The ETC module 202 senses pivotable movement of the lower pedal arm 14 and sends electronic signals regarding such via a electric cable or wire connected thereto. The electronic throttle control module can be of any suitable type known in the art.

To adjust the control pedal 200, the driver engages a control switch which activates rotation of the motor 88 in the desired direction. Rotation of the motor 88 rotates the drive screw 84 through the drive cable 90 and causes the drive nut 68 to axially move along the drive screw 84 in the desired direction. The drive nut 68 moves along the drive screw 84 because the drive nut 68 is held against rotation with the drive screw 84 by the drive pin 38. As the drive nut 68 axially moves along the drive screw 64, the drive pin 38 moves along the upper slot 28 because the drive pin 38 is secured to the drive nut 68. It is noted that binding of the drive nut 68 along the drive screw 84 is minimized if a self-aligning joint is provided, between the drive screw 84 and the drive screw housing 86 and/or the drive nut 68 and the drive pin 38, to automatically align the components so that the drive nut 68 can smoothly travel along the drive screw 84. As the drive pin 38 slidingly moves along the upper slot 28, the upper pedal arm 12 is moved therewith to adjust the forward/rearward position of the pedal 16. As the upper pedal arm moves 12, the guide pin 36 slides along the lower slot 30. With such movement, the pedal 16 travels in a substantially linear and horizontal path, that is, the pedal 16 moves in a forward/rearward direction and generally remains at the same height relative to the fixed mounting bracket 20 during adjustment of the pedal 16. Additionally, the pedal 16 is not rotated as the upper pedal arm 12 moves so that the orientation of the pedal does not change. It can be seen from the above description that activation of the motor 88 changes the position of the upper and lower pedal arms 12, 14 relative to the mounting bracket 20 but not the position of the upper pedal arm 12 relative to the lower pedal arm 14 and therefore does not affect the rotational sensing of the ETC module 202.

Figure 13:
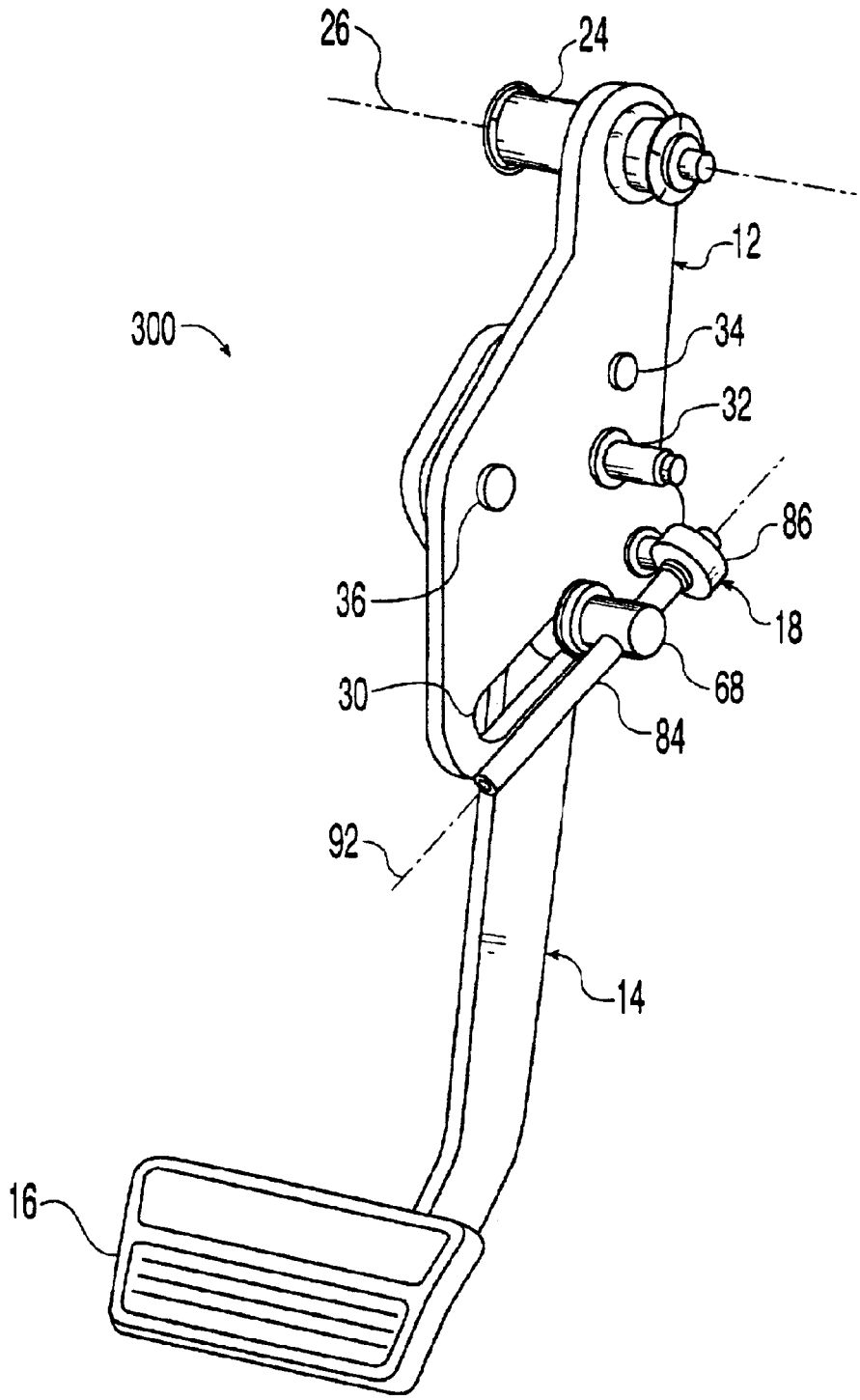
FIG. 13 is a right-rear perspective view of an adjustable control pedal according to a fourth embodiment of the present invention.
Figure 14:
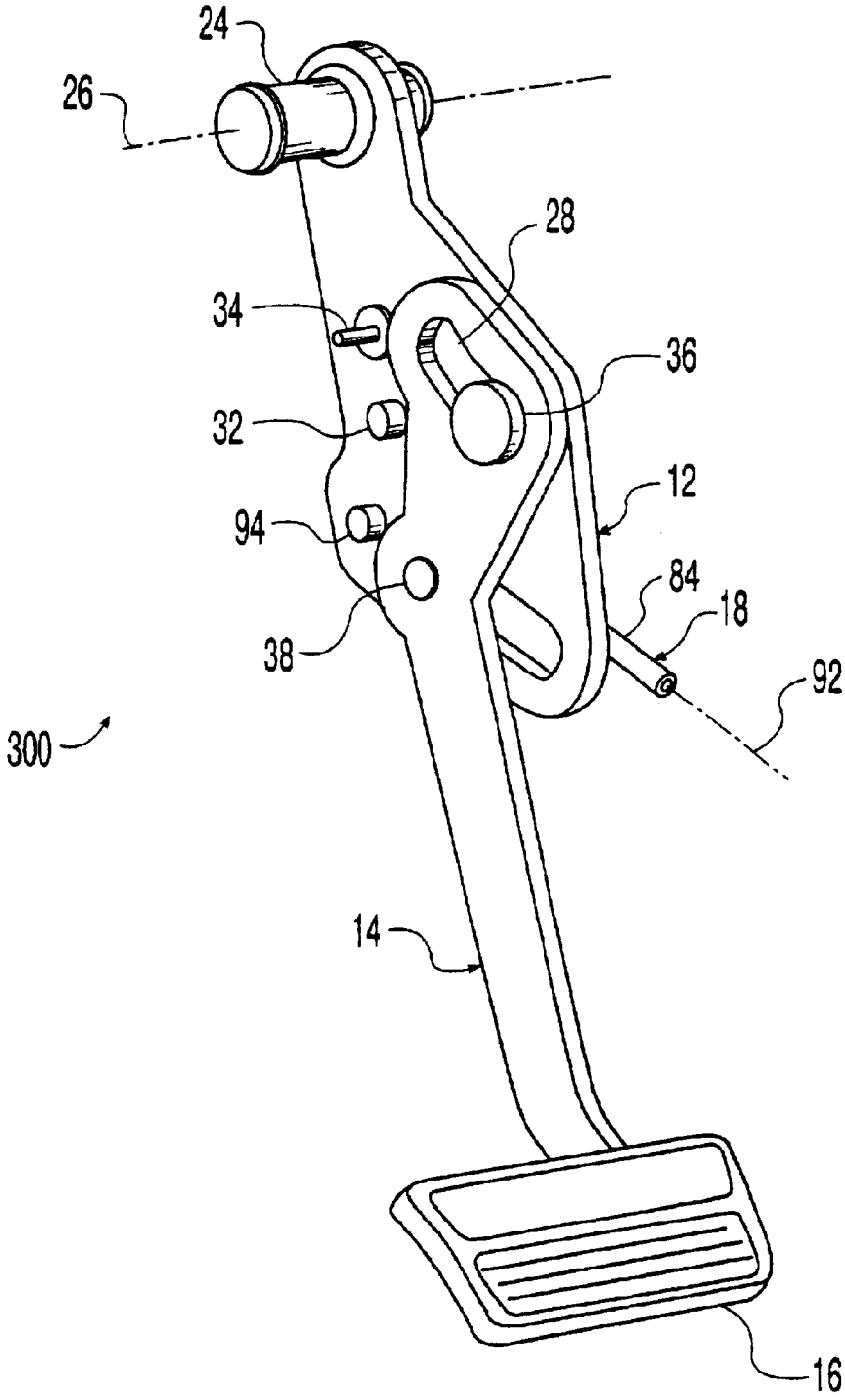
FIG. 14 is a left-rear perspective view of the adjustable control pedal of FIG. 13.
Figure 15:
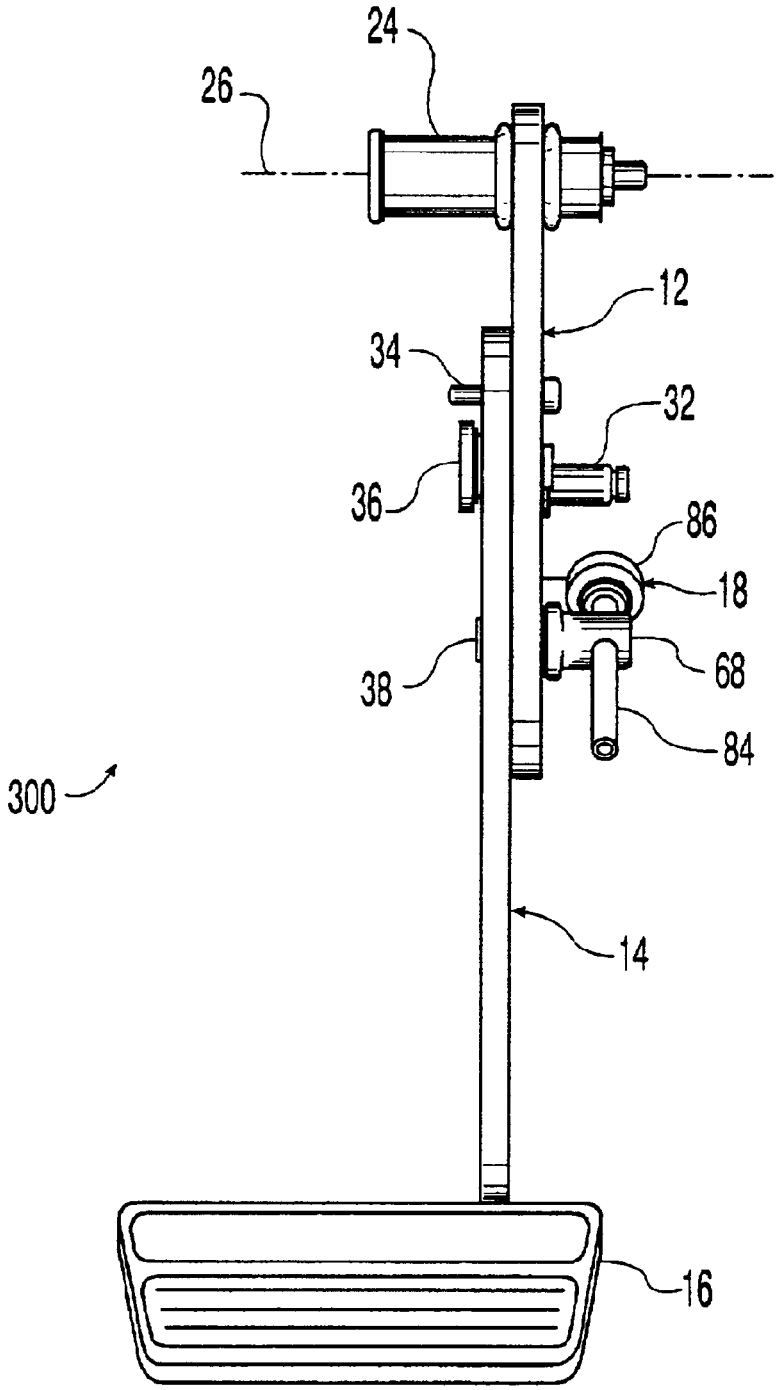
FIG. 15 is a rear elevational view of the adjustable control pedal of FIGS. 13 and 14.

FIGS. 13 to 15 illustrate a control pedal 300 for a motor vehicle according to a fourth embodiment of the present invention wherein like reference numbers are used for like structure. The illustrated control pedal 300 is a brake pedal. The control pedal 300 according to the fourth embodiment is substantially similar to the first and second embodiments described herein above with reference to FIGS. 1-8, except that the guide pin slot 28 is formed in the lower pedal arm 14, rather than the upper pedal arm 12, and the guide pin 36 is secured to the upper pedal arm 12, rather than the lower pedal arm 14. Formed in this manner, the upper and lower pedal arms 12, 14 each have one of the slots 28, 30 formed therein and each have one of the pins 36, 38 secured thereto. The control pedal 300 is adjusted substantially as described in detail herein above with regard to the first and second embodiments.

Figure 16:
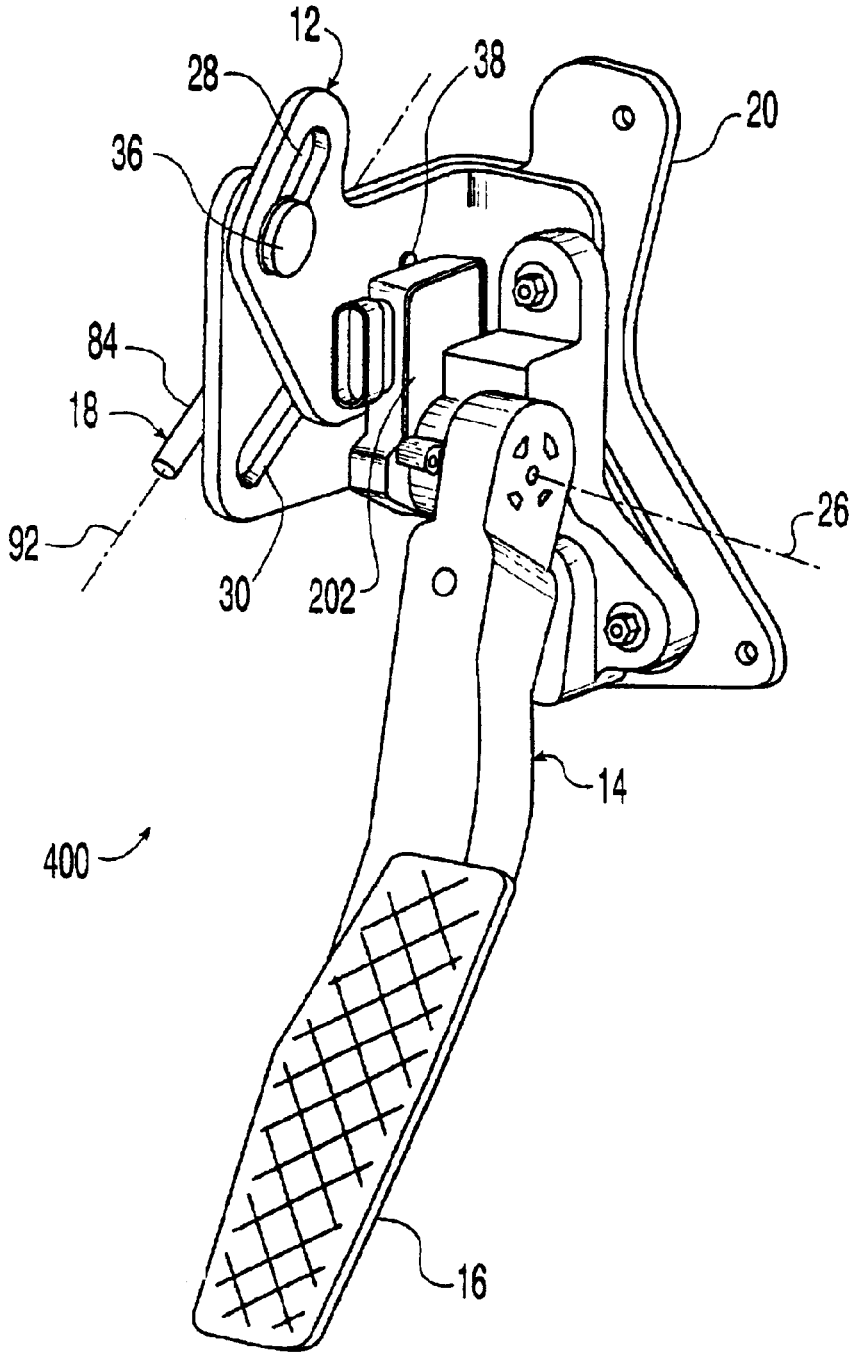
FIG. 16 is a right-rear perspective view of an adjustable control pedal according to a fifth embodiment of the present invention.
Figure 17:
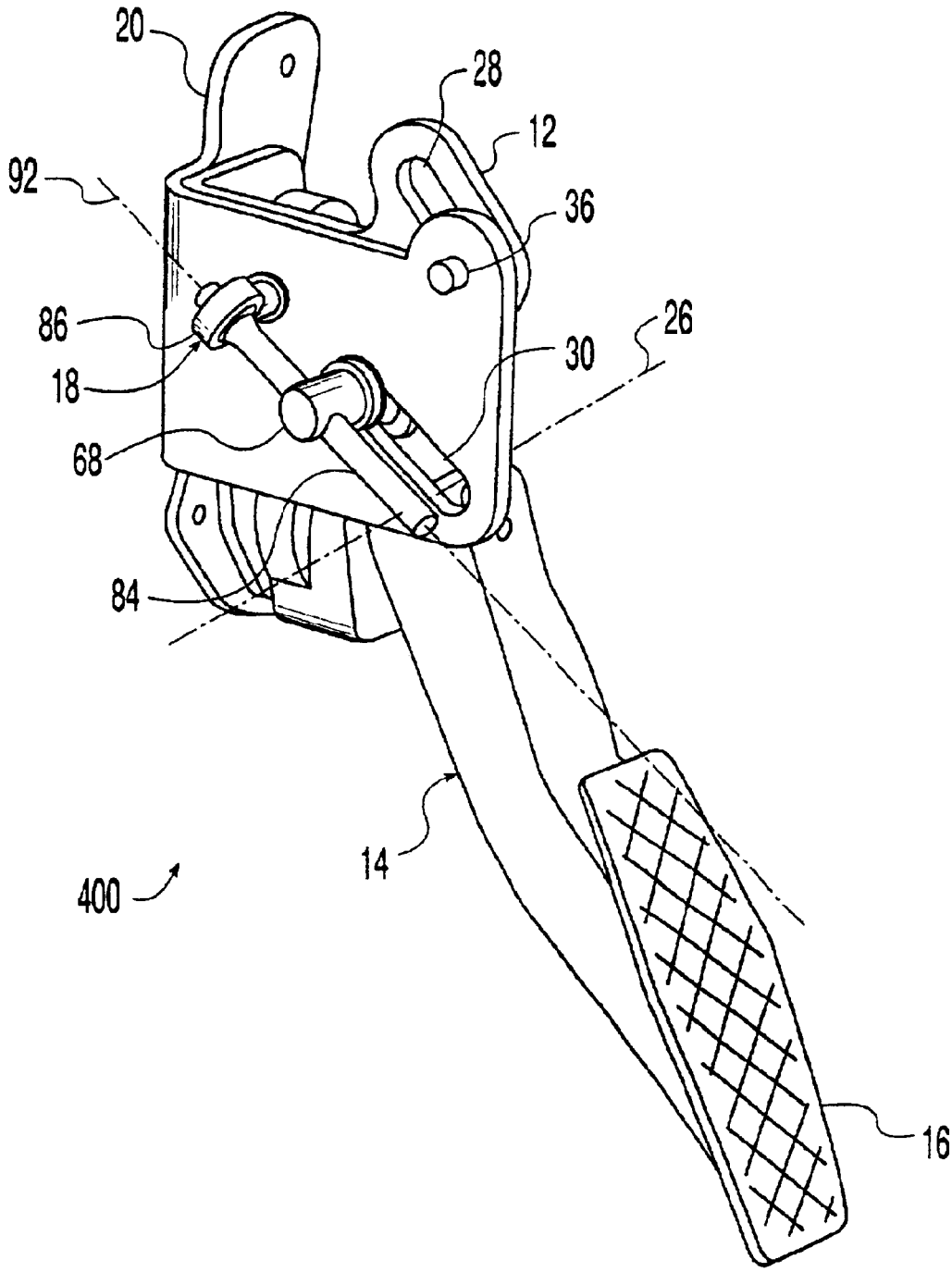
FIG. 17 is a left-rear perspective view of the adjustable control pedal of FIG. 16.
Figure 18:
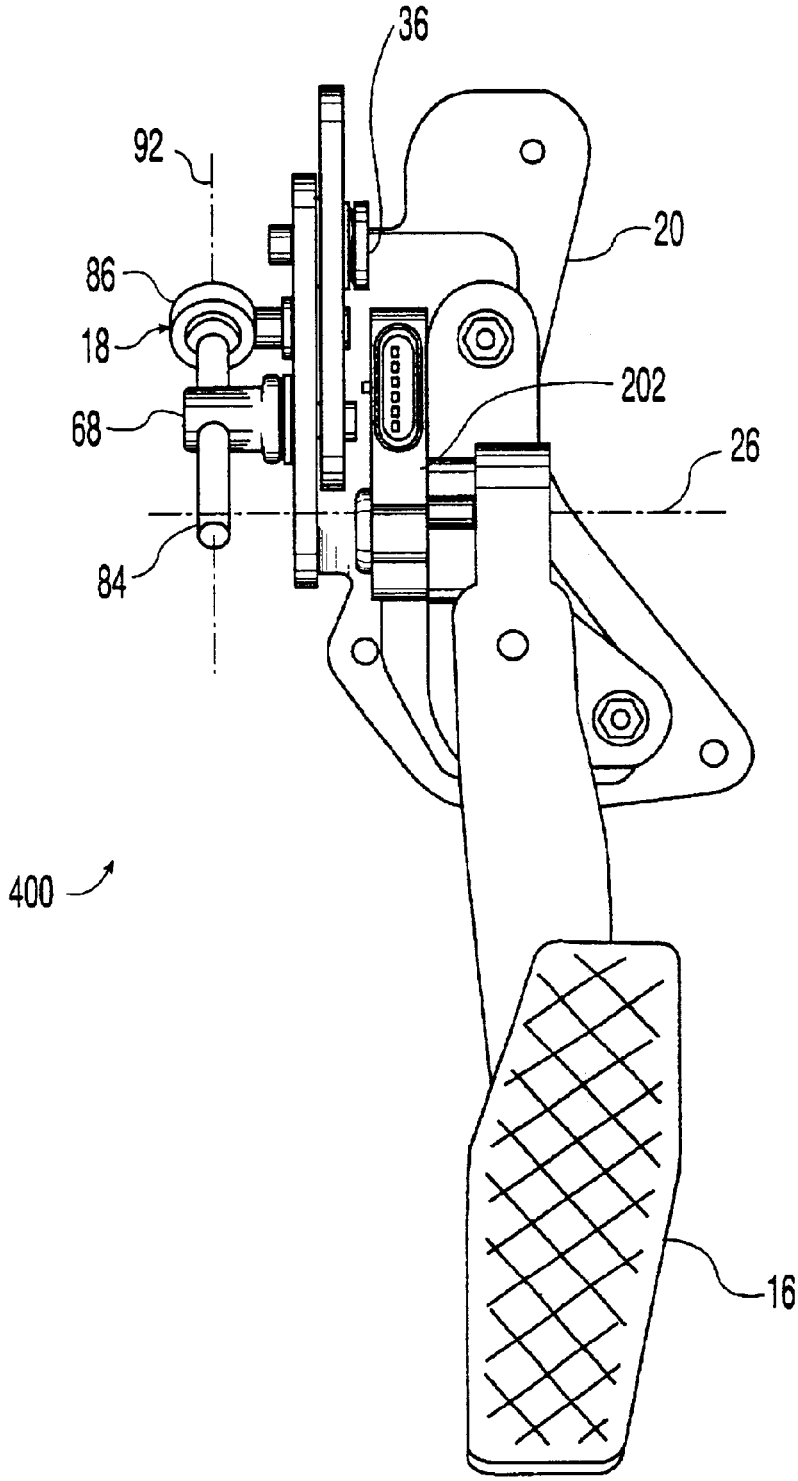
FIG. 18 is a rear elevational view of the adjustable control pedal of FIGS. 16 and 17.

FIGS. 16 to 18 illustrate a control pedal 400 for a motor vehicle according to a fifth embodiment of the present invention wherein like reference numbers are used for like structure. The illustrated control pedal 400 is an accelerator pedal having electronic throttle control. The control pedal 400 according to the fifth embodiment is substantially similar to the third embodiment described herein above with reference to FIGS. 10 to 12, except that the guide pin slot 28 is formed in the upper pedal arm 12, rather than the mounting bracket 20, and the guide pin 36 is secured to the mounting bracket 20, rather than the upper pedal arm 12. Formed in this manner, the upper pedal arm 12 and the mounting bracket 20 each have one of the slots 28, 30 formed therein and each have one of the pins 36, 38 secured thereto. The control pedal 400 is substantially adjusted as described in detail herein above with regard to the third embodiment.

It should be appreciated that each of the features of the various embodiments can be utilized separately or in combination with each of the features of the other embodiments. For example, the first and third embodiments can be provided with inclined slots like the second, fourth, and fifth embodiments when a reduced package size is desired and the second, fourth, and fifth embodiments can be provided with horizontal parallel slots like the first and third embodiments when a linear pedal path without orientation change of the pedal is desired.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the slots can have many different forms. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. An adjustable control pedal comprising, in combination:

a pivotable upper arm having first and second guide slots and a drive slot formed therein;

wherein the upper arm pivots about a pivot axis which is spaced apart from the drive slot;

wherein the first and second guide slots and the drive slot are each straight;

a lower arm having a lower end carrying a pedal and operatively connected to the upper arm for selected movement relative to the upper arm;

a first pin secured to the lower arm and laterally extending into the first guide slot;

a second pin secured to the lower arm and laterally extending into the second guide slot; and a drive assembly operatively connected to the lower arm to selectively move the lower arm relative to the upper arm and including:

a screw carried by the upper arm so that the screw moves with the upper arm as the upper arm pivots about the pivot axis and remains at a fixed location relative to the upper arm as the lower arm is selectively moved relative to the upper arm;

a nut secured to the lower arm, laterally extending through the drive slot from the lower arm to the screw, threadably engaging the screw, and adapted to axially move along the screw upon rotation of the screw to move the lower arm relative to the upper arm; and a motor operatively connected to the screw to selectively rotate the screw.

2. The adjustable control pedal according to claim 1, wherein the first and second guide slots are formed on opposite sides of the drive slot.

3. The adjustable control pedal according to claim 1, wherein the first and second guide slots are nonparallel.

4. The adjustable control pedal according to claim 3, wherein the first and second guide slots are inclined.

5. The adjustable control pedal according to claim 1, wherein weight of the lower arm is supported by the upper arm through the first and second pins.

6. The adjustable control pedal according to claim 1, wherein the upper arm pivots about a pivot axis which remains at a fixed location relative to the upper arm as the lower arm is selectively moved relative to the upper arm.

7. The adjustable control pedal according to claim 1, further comprising a third pin secured to the upper arm for connection to a device to be controlled by operation of the adjustable control pedal.

8. The adjustable control pedal according to claim 1, wherein the drive slot is inclined.

9. The adjustable control pedal according to claim 1, wherein the first and second guide slots extend entirely through the upper arm and the first and second pins extend entirely through the first and second guide slots respectively.

10. The adjustable control pedal according to claim 1, the lower arm is located adjacent a first lateral side of the drive slot of the upper arm and the screw is located adjacent second lateral side of the drive slot of the upper arm opposite the first lateral side so that the lower arm and the screw are located on opposite lateral sides of the drive slot of the upper arm and the nut laterally extends through the drive slot from the lower arm to the screw.

11. An adjustable control pedal comprising, in combination:

a pivotable upper arm having first and second guide slots and a drive slot formed therein;

wherein the first and second guide slots are each straight;

wherein the upper arm pivots about a pivot axis;

a lower arm having a lower end carrying a pedal and operatively connected to the upper arm for selected movement relative to the upper arm;

a first pin secured to the lower arm and laterally extending into the first guide slot;

a second pin secured to the lower arm and laterally extending into the second guide slot;

a drive assembly operatively connected to the lower arm to selectively move the lower arm relative to the upper arm and including:

a screw carried by the upper arm so that the screw moves with the upper arm as the upper arm pivots about the pivot axis and remains at a fixed location relative to the upper arm as the lower arm is selectively moved relative to the upper arm;

a nut secured to the lower arm, laterally extending through the drive slot from the lower arm to the screw, threadably engaging the screw, and adapted to axially move along the screw upon rotation of the screw to move the lower arm relative to the upper arm; and a motor operatively connected to the screw to selectively rotate the screw; and wherein the pivot axis remains at a fixed location relative to the upper arm as the lower arm is selectively moved relative to the upper arm.

12. The adjustable control pedal according to 11, claim wherein the first and second guide slots are formed on opposite sides of the drive slot.

13. The adjustable control pedal according to claim 11, wherein the first and second guide slots are nonparallel.

14. The adjustable control pedal according to claim 13, wherein the first and second guide slots are inclined.

15. The adjustable control pedal according to claim 11, wherein the pivot axis is spaced apart from the drive slot.

16. The adjustable control pedal according to claim 11, wherein the drive slot is inclined.

17. The adjustable control pedal according to claim 11, wherein the first and second guide slots extend entirely through the upper arm and the first and second pins extend entirely through the first and second guide slots respectively.

18. The adjustable control pedal according to claim 11, wherein the lower arm is located adjacent a first lateral side of the drive slot of the upper arm and the screw is located adjacent second lateral side of the drive slot of the upper arm opposite the first lateral side so that the lower arm and the screw are located on opposite lateral sides of the drive slot of the upper arm and the nut laterally extends through the drive slot from the lower arm to the screw.

19. An adjustable control pedal comprising, in combination:

a pivotable upper arm having first and second guide slots and a drive slot formed therein;

wherein the first and second guide slots and the drive slot are each straight;

wherein the upper arm pivots about a pivot axis spaced apart from the drive slot;

a lower arm having a lower end carrying a pedal and operatively connected to the upper arm for selected movement relative to the upper arm;

a first pin secured to the lower arm and laterally extending into the first guide slot;

a second pin secured to the lower arm and laterally extending into the second guide slot;

a drive assembly operatively connected to the lower arm to selectively move the lower arm relative to the upper arm and including:

a screw carried by the upper arm so that the screw moves with the upper arm as the upper arm pivots about the pivot axis and remains at a fixed location relative to the upper arm as the lower arm is selectively moved relative to the upper arm;

a nut secured to the lower arm, laterally extending through the drive slot from the lower arm to the screw, threadably engaging the screw, and adapted to axially move along the screw upon rotation of the screw to move the upper arm relative to the lower arm; and a motor operatively connected to the screw to selectively rotate the screw; and wherein the pivot axis remains at a fixed location relative to the upper arm as the lower arm is selectively moved relative to the upper arm.

20. The adjustable control pedal according to claim 19, wherein the first and second guide slots are formed on opposite sides of the drive slot.

21. The adjustable control pedal according to claim 19, wherein the first and second guide slots are nonparallel.

22. The adjustable control pedal according to claim 21, wherein the first and second guide slots are inclined.

23. The adjustable control pedal according to claim 19, wherein the drive slot is inclined.

24. The adjustable control pedal according to claim 19, wherein the lower arm is located adjacent a first lateral side of the drive slot of the upper arm and the screw is located adjacent second lateral side of the drive slot of the upper arm opposite the first lateral side so that the lower arm and the screw are located on opposite lateral sides of the drive slot of the upper arm and the nut laterally extends through the drive slot from the lower arm to the screw.

* * * * *